US012778260B2

(12) United States Patent
Feliciano et al.

(10) Patent No.: US 12,778,260 B2
(45) Date of Patent: Nov. 3, 2026

(54) AIRLESS HAIRDRYER

(71) Applicant: L'Oreal, Paris (FR)

(72) Inventors: Rafael Feliciano, New Providence, NJ (US); Gregoire Charraud, Jersey City, NJ (US)

(73) Assignee: L'Oréal, Paris (FR)

( * ) Notice: Subject to any disclaimer, the term of this patent is extended or adjusted under 35 U.S.C. 154(b) by 510 days.

(21) Appl. No.: 18/478,080

(22) Filed: Sep. 29, 2023

(65) Prior Publication Data

US 2025/0107609 A1 Apr. 3, 2025

(51) Int. Cl.
*A45D 20/48* (2006.01)

(52) U.S. Cl.
CPC ..... *A45D 20/48* (2013.01)

(58) Field of Classification Search
CPC ..... A45D 20/48
USPC ..... 34/246, 95–100
See application file for complete search history.

(56) References Cited

U.S. PATENT DOCUMENTS

| | | | | |
|---|---|---|---|---|
| 9,854,893 | B2 * | 1/2018 | Robinson | A45D 20/12 |
| 11,633,028 | B2 * | 4/2023 | Kim | A45D 20/122 34/97 |
| 11,641,918 | B2 * | 5/2023 | Jeong | A45D 20/12 34/97 |
| 12,213,574 | B1 * | 2/2025 | Varma | A46B 9/023 |
| 12,290,157 | B2 * | 5/2025 | Kosecoff | A46B 15/0022 |
| 12,389,996 | B1 * | 8/2025 | Goldman | A45D 20/12 |
| 2009/0165811 | A1 * | 7/2009 | Zimmerman | A45D 2/362 132/203 |
| 2012/0167323 | A1 * | 7/2012 | Williams | A46B 9/02 15/160 |
| 2019/0098977 | A1 * | 4/2019 | Thiebaut | A45D 20/10 |
| 2021/0315354 | A1 * | 10/2021 | Kim | A45D 20/12 |
| 2023/0080940 | A1 * | 3/2023 | Xu | A61H 7/005 132/219 |
| 2025/0107609 | A1 * | 4/2025 | Feliciano | A45D 20/48 |
| 2026/0041929 | A1 * | 2/2026 | Charraud | A61N 5/0616 |

FOREIGN PATENT DOCUMENTS

| | | | | |
|---|---|---|---|---|
| CN | 113892743 | A * | 1/2022 | A61H 11/00 |
| EP | 1285599 | A2 | 2/2003 | |
| FR | 3108833 | A1 | 10/2021 | |
| FR | 3119084 | A1 | 7/2022 | |
| FR | 3123789 | A1 * | 12/2022 | A46B 15/0026 |

(Continued)

OTHER PUBLICATIONS

Preliminary Search Report and Written Opinion mailed Jul. 15, 2024, issued in corresponding French Application No. 2401333, filed Feb. 12, 2024, 7 pages.

*Primary Examiner* — Stephen M Gravini
(74) *Attorney, Agent, or Firm* — CHRISTENSEN O'CONNOR JOHNSON KINDNESS PLLC

(57) ABSTRACT

An airless hairdryer including a body, a plurality of tines protruding from the body. Each tine of the plurality of tines includes a positive electrode, and a negative electrode, where the positive electrodes and the negative electrodes of the plurality of tines are arranged in an alternating pattern. The airless hairdryer further includes a current source configured to generate alternating electric fields between each tine in the plurality of tines, where each alternating electric field is between one positive electrode of one tine and one negative electrode of an adjacent tine.

18 Claims, 14 Drawing Sheets

(56) References Cited

FOREIGN PATENT DOCUMENTS

| | | | | | |
|---|---|---|---|---|---|
| GB | 801286 | A | | 9/1958 | |
| TW | 202137908 | A | * | 10/2021 | ..... A45D 20/12 |
| WO | 2021132788 | A1 | | 7/2021 | |
| WO | WO-2021206229 | A1 | * | 10/2021 | ..... A45D 20/122 |
| WO | WO-2022258365 | A1 | * | 12/2022 | ..... A46B 11/0062 |

* cited by examiner

AIRLESS HAIRDRYER

SUMMARY

In one aspect, disclosed herein is an airless hairdryer including a body, a plurality of tines protruding from the body, each tine of the plurality of tines including a positive electrode, and a negative electrode, where the positive electrodes and the negative electrodes of the plurality of tines are arranged in an alternating pattern, and a current source configured to generate alternating electric fields between each tine in the plurality of tines, where each alternating electric field is between one positive electrode of one tine and one negative electrode of an adjacent tine.

In some embodiments, the plurality of tines is disposed in a line. In some embodiments, the plurality of tines is disposed in an array. In some embodiments, the adjacent tine is one or more tines directly next to the one tine.

In some embodiments, the body comprises a barrel. In some embodiments, the body includes a first face, a second face, and a clamp mechanism configured to bring the first face and the second face towards each other. In some embodiments, plurality of tines is located on the first face, the second face, or both the first face and the second face. In some embodiments, the plurality of tines is located on a first side of the first face, a second side of the first face, a first side of the second face, a second side of the second face, or a combination thereof.

In some embodiments, the airless hairdryer includes a temperature sensor configured to sense a temperature of a scalp. In some embodiments, the airless hairdryer includes a vapor sensor configured to detect a dryness of the hair.

In some embodiments, each tine of the plurality of tines includes a vapor sensor, each vapor sensor configured to detect a dryness of the scalp, and when the dryness detected by the vapor sensor meets or exceeds a dryness threshold, an alternating electric field of the respective tines of the plurality of tines is disabled.

In some embodiments, the airless hairdryer includes at least one infrared (IR) light-emitting diode (LED) configured to further dry the hair.

In another aspect, disclosed herein is a method of drying hair with the airless hairdryer described herein. In some embodiments, the method includes moving the plurality of tines through hair, generating alternating electric fields between each tine in the plurality of tines, where each alternating electric field is between one positive electrode of one tine and one negative electrode of an adjacent tine.

In some embodiments, the airless hairdryer includes a first face, a second face, and a clamp mechanism, and the method includes clamping the first face and the second face towards each other as the plurality of tines is moved through the hair.

In some embodiments, the airless hairdryer includes a temperature sensor, and the method includes detecting a temperature of a scalp, and, when the temperature meets or exceeds a temperature threshold, disabling the alternating electrical fields.

In some embodiments, the temperature sensor is one temperature sensor of a plurality of temperature sensors, where each tine of the plurality of tines comprises a temperature sensor, and the method includes disabling an alternating electrical field of respective tines of the plurality of tines when a respective temperature sensor detects a temperature of the scalp meeting or exceeding the temperature threshold.

In some embodiments, the airless hairdryer includes a vapor sensor, and wherein the method includes detecting a dryness of the hair, and when the temperature meets or exceeds a dryness threshold, disabling the alternating electrical field.

In some embodiments, the vapor sensor is one vapor sensor of a plurality of vapor sensors, where each tine of the plurality of tines comprises a vapor sensor, and the method includes disabling the alternating electrical field of respective tines of the plurality of tines when a respective vapor sensor detects a dryness of the hair meeting or exceeding the dryness threshold.

In some embodiments, the airless hairdryer includes at least one infrared (IR) light-emitting diode (LED), and the method includes drying the hair with the at least one IR LED. In some embodiments, the airless hairdryer includes at least one vapor sensor and at least one IR LED, and the method further includes detecting a dryness of a scalp, when the dryness meets or exceeds a dryness threshold, disabling the alternating electrical field, and switching to drying the hair with the at least one IR LED.

In some embodiments, the method includes redetecting the dryness of the scalp, and when the dryness meets or exceeds a second dryness threshold, turning off the at least one IR LED.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Described herein is example airless hairdryers and methods of using them. Generally, the airless hairdryers are configured to dry a user's hair by generating alternating electric fields between each tine of a plurality of tines located on a body of the airless hairdryer. Each tine of the plurality of tines includes a positive electrode and a negative electrode. In some embodiments, the alternating electric fields are generated between a positive electrode (or negative electrode) of one tine and a negative electrode (or positive electrode) of an adjacent tine. The plurality of tines may be arranged in many ways, including in a line or in an array. Depending on the arrangement of the positive and negative electrodes inside (or on the outside) of each tine, the alternating electric fields may be generated between each column of tines in the array of tines, each row of tines in the array of tines, both the columns and rows of the array of tines, or along each diagonal line of the array of tines. In some embodiments, the airless hairdryer includes one or more sensors, such as a temperature sensor, a proximity sensor, and/or a vapor sensor. Each sensor may measure a quality (such as temperature, proximity, or dryness) of hair or a scalp. These measured qualities may be received by a processor on the airless hairdryer, configured to start, control, or end the alternating electric field drying. In some embodiments, the airless hair dryer may include one or more alternate heating mechanisms, including heating plates, infrared light emitting diodes (IR LEDs), and the like. These alternating heating mechanisms may be used before, during, after, or alternating with the alternating electric fields.

Figure 1A:
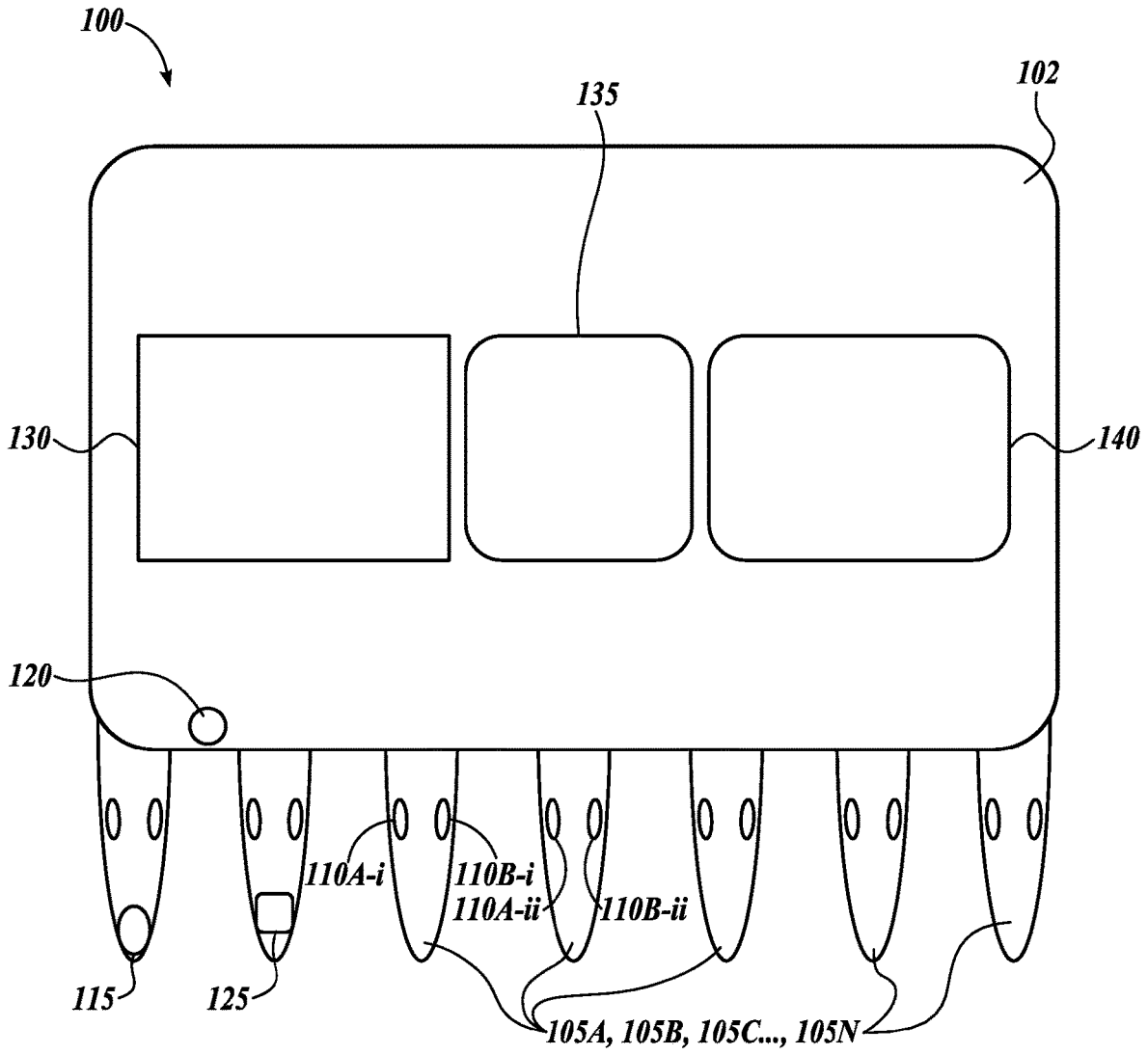
FIG. 1A is an internal view of an example airless hairdryer, in accordance with the present technology.

FIG. 1A is an internal view of an example airless hairdryer 100, in accordance with the present technology. In some embodiments, the airless hairdryer 100 is shaped like a comb. In some embodiments, the airless hairdryer 100 includes a body 102, a plurality of tines 105A, 105B, 105C . . . 105N, at least one temperature sensor 115, at least one a vapor sensor 120, at least one a proximity sensor 125, a processor 130, a current source 135, and a power source 140.

In some embodiments, each tine 105 of the plurality of tines 105A, 105B, 105C includes a positive electrode 110A-i, 110A-ii and a negative electrode 110B-i, 110B-ii. In some embodiments, the positive electrodes 110A-i, 110A-ii and the negative electrodes 110B-i, 110B-ii are alternated inside each tine 105. In this manner, a negative electrode (such as negative electrode 110B-i) of one tine (such as tine 105A) is adjacent to a positive electrode (such as positive electrode 110A-ii) of an adjacent tine (such as tine 105B). In some embodiments, a first tine and last tine on the airless hair dryer 100 may only include a negative electrode 110B or a positive electrode 110A-i, 110A-ii, respectively. In some embodiments, the plurality of tines 105A, 105B, 105C . . . 105N are disposed in a line along the body 102 of the airless hairdryer 100. While the positive electrodes 110A-i, 110A-ii are illustrated as being on the left side of each tine of the plurality of tines 105A, 105B, 105C . . . 105N and the negative electrodes 110B-i, 110B-ii are illustrated as being on the right side of each tine of the plurality of tines 105A, 105B, 105C . . . 105N, one skilled in the art will understand that the positive electrodes 110A-i, 110A-ii could be located on the right side and the negative electrodes 110B-i, 110B-ii could be located on the left side.

In some embodiments, the airless hairdryer 100 includes at least one temperature sensor 115. In some embodiments, the at least one temperature sensor 115 is located in at least one tine 105 of the plurality of tines 105A, 105B, 105C . . . 105N. In some embodiments, the temperature sensor 115 is configured to sense a temperature of a user's scalp.

In some embodiments, the airless hairdryer 100 includes at least one vapor sensor 120 (also referred to herein as "the vapor sensor" 120). In some embodiments, the vapor sensor 120 is located in the body 102 of the airless hairdryer 100. In some embodiments, the vapor sensor 120 is configured to sense a dryness level of hair. In some embodiments, the vapor sensor 120 is a capacitance sensor that converts capacitance to a humidity reading (or dryness level).

In some embodiments, the airless hairdryer 100 includes at least one a proximity sensor 125. In some embodiments, the proximity sensor 125 is located in at least one tine 105 of the plurality of tines 105A, 105B, 105C . . . 105N. In some embodiments, the proximity sensor 115 is configured to sense the distance between the plurality of tines 105A, 105B, 105C . . . 105N and a user's scalp. In some embodiments, the proximity sensor 115 is a contact sensor, configured to sense the user's scalp when the proximity sensor 115 touches the user's scalp.

The processor 130 may be located inside the body 102 of the airless hairdryer 100. In some embodiments, the processor 130 is communicatively coupled with the temperature sensor 115, the vapor sensor 120, and/or the proximity sensor 125. In some embodiments, the processor 130 is communicatively coupled to the current source 135, the power source 140, or both.

In some embodiments, the airless hairdryer 100 includes a current source 135. In some embodiments, the current source 135 is configured to generate alternating electric fields between a negative electrode (such as negative electrode 110B-i) of one tine 105 and a positive electrode (such as positive electrode 110A-ii) of an adjacent tine 105, as shown and described in FIGS. 2A-2B. In some embodiments, the current source is a radiofrequency (RF) generator.

In some embodiments, the airless hairdryer 100 includes a power source 140. In some embodiments, the power source 140 may be a battery. In some embodiments, the power source 140 may be a rechargeable battery or a single-use battery. In some embodiments, the power source 140 is removable from the body 102 of the airless hairdryer 100. In some embodiments, the power source 140 may include a wired connection (as shown in FIG. 3A).

Figure 2A:
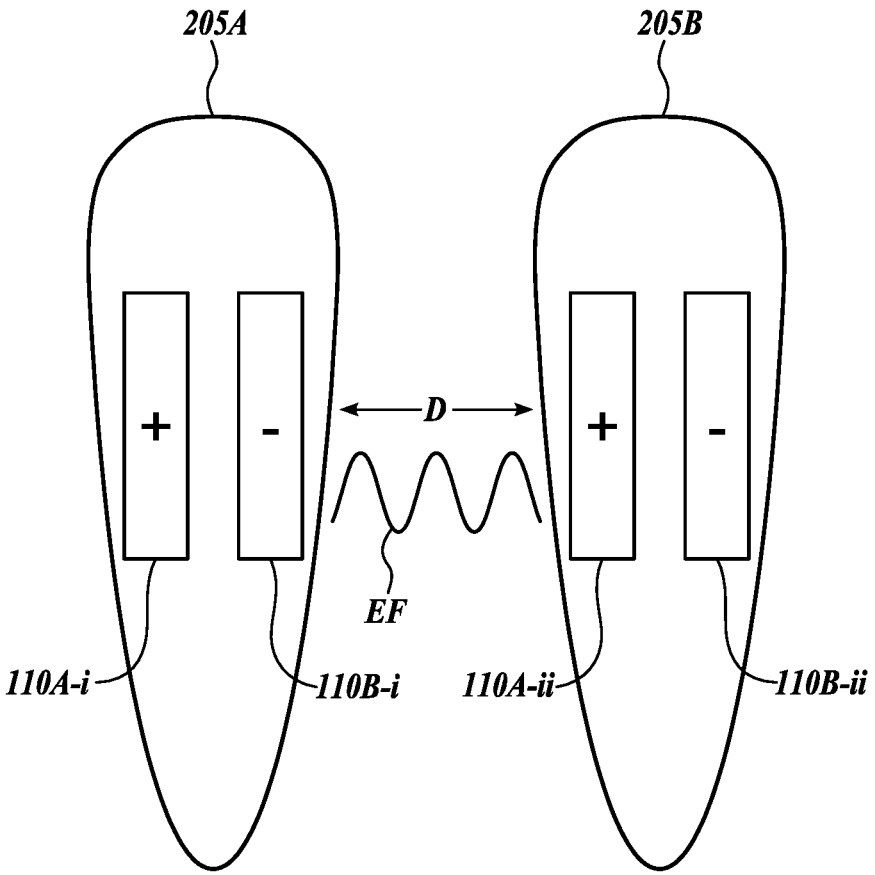
FIG. 2A is a close up view of two respective tines of a plurality of tines, in accordance with the present technology.

In operation, the current source 135 generates an alternating electric field between each tine 105 of the plurality of tines 105A, 105B, 105C . . . 105N. Specifically, the alternating electric fields are generated between each tine, between a negative electrode 110B-i of one tine 105A and a positive electrode 110A-ii of another tine 105B, as shown in FIG. 2A. Because the positive electrodes 110A and the negative electrodes 110B are alternated in the plurality of tines 105A, 105B, 105C . . . 105N, alternating electric fields may be generated between each tine. In some embodiments, the alternating electric fields are from 1 to 300 MHz in frequency. The alternating electric fields may be radiofrequency (RF). In some embodiments, the alternating electric fields are configured to dry hair, as illustrated, and described in FIGS. 2A-2B.

In some embodiments, the processor 130 is configured to direct the temperature sensor 115, the vapor sensor 120, and/or the proximity sensor 125. In some embodiments, the temperature sensor 115 measures a temperature of a user's scalp.

In some embodiments, the measured temperature is transmitted to the processor 130. In some embodiments, the processor 130 is configured to receive the measured temperature and determine if the measured temperature meets or exceeds a temperature threshold. In some embodiments, if the measured temperature meets or exceeds the temperature threshold, the processor 130 is configured to turn off the airless hairdryer 100.

In some embodiments, the vapor sensor 120 is configured to measure a dryness of the user's hair. In some embodiments, the measured dryness is transmitted to the processor 130. The processor 130 may compare the measured dryness to a dryness threshold. If the measured dryness meets or exceeds the dryness threshold, the processor 130 may turn off the airless hairdryer.

In some embodiments, proximity sensor 125 is configured to determine that the plurality of tines 105A, 105B, 105C . . . 105N are proximate to the user's hair and/or scalp. In some embodiments, the proximity sensor 125 transmits a measured proximity to the user's hair and/or scalp. In some embodiments, the processor 130 determines if the measured proximity meets or exceeds a proximity threshold. If the measured proximity meets or exceeds the proximity threshold, the processor 130 directs the current source 135 to generate the alternating electric field. If the measured proximity is below the proximity threshold, the processor 130 may direct the current source 135 to not generate the alternating electric field and/or stop generating the alternating electric field. In some embodiments, the processor 130 may alert or otherwise direct the user to move the airless hairdryer 100 closer to the hair or scalp.

Figure 1B:
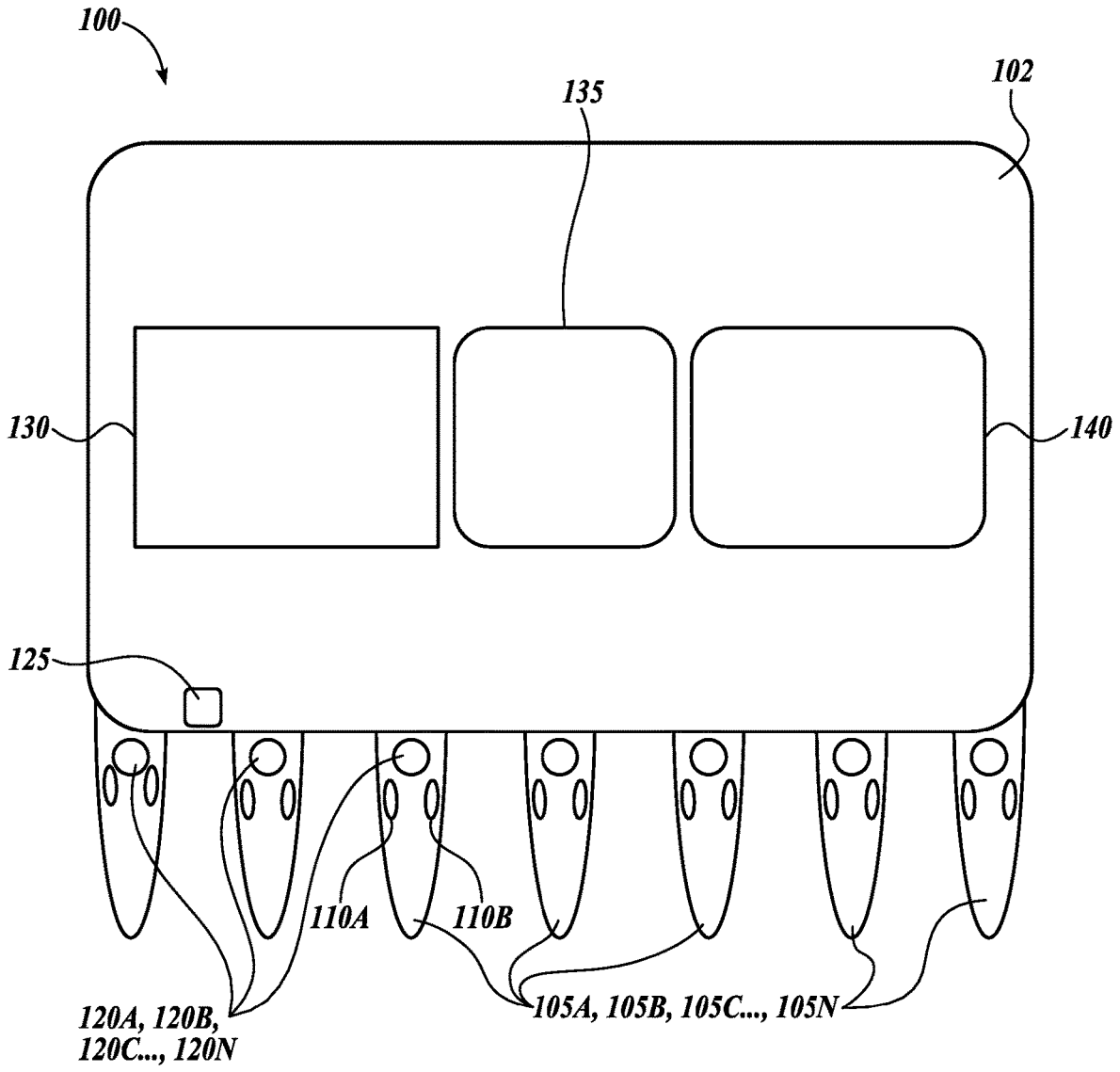
FIG. 1B is another internal view of an example airless hairdryer, in accordance with the present technology.

FIG. 1B is another internal view of an example airless hairdryer 100, in accordance with the present technology. In some embodiments, the airless hairdryer 100 includes a body 102, a plurality of tines 105A, 105B, 105C . . . 105N, a plurality of vapor sensors 120A, 120B, 120C . . . 120N, at least one a proximity sensor 125 located in the body 102, a processor 130, a current source 135, and a power source 140.

In some embodiments, the plurality of vapor sensors 120A, 120B, 120C . . . 120N may be located in the plurality of tines 105A, 105B, 105C . . . 105N. In some embodiments, each tine 105 of the plurality of tines 105A, 105B, 105C . . . 105N includes a vapor sensor 120A, 120B, 120C . . . 120N. In some embodiments, one or more tines 105 may not include a vapor sensor. In some embodiments, each vapor sensor of the plurality of vapor sensors 120A, 120B, 120C . . . 120N is located at the base of each tine of the plurality of tines 105A, 105B, 105C . . . 105N. This allows each vapor sensor of the plurality of vapor sensors 120A, 120B, 120C . . . 120N to measure the dryness of hair as it is combed through or brushed through by the plurality of tines 105A, 105B, 105C . . . 105N.

In operation, as the airless hair dryer 100 is moved through hair, each vapor sensor of the plurality of vapor sensors 120A, 120B, 120C . . . 120N may measure the dryness level of the hair independently. In some embodiments, the plurality of vapor sensors 120A, 120B, 120C . . . 120N is a plurality of capacitance sensors that convert capacitance to a humidity reading (or dryness level). In such embodiments, when any measured dryness from any vapor sensor of the plurality of vapor sensors 120A, 120B, 120C . . . 120N meets or exceeds the dryness threshold, the processor 130 may direct the current source to stop supplying current to the tine of the plurality of tines 105A, 105B, 105C . . . 105N including the vapor sensor that measured the dryness level meeting or exceeding the dryness level threshold. In this manner, an alternating electric field will not be generated between the tine and an adjacent tine of the plurality of tines 105A, 105B, 105C . . . 105N but will still be generated between all other tines of the plurality of tines 105A, 105B, 105C. In some embodiments, when even one vapor sensor of the plurality of vapor sensors 120A, 120B, 120C . . . 120N meets or exceeds the dryness level threshold, the current source 135 stops generating the alternating electric fields to all tines of the plurality of tines 105A, 105B, 105C . . . 105N, i.e., stops supplying current to the plurality of tines 105A, 105B, 105C . . . 105N.

FIG. 2A is a close-up view of two respective tines 205A, 205B of a plurality of tines, in accordance with the present technology. Tines 205A, 205B may be single tines within a plurality of tines, as shown in FIGS. 1A-1B. Tine 205A may be referred to herein as "one tine". One skilled in the art should understand that any tine of the plurality of tines described herein may be "one tine". Similarly, tine 205B may be referred to herein as an "adjacent tine". One skilled in the art should understand that any tine directly next to another tine may be an "adjacent tine". Adjacent tine 205B may be disposed in any direction from the one tine 205A. In some embodiments, such as when the plurality of tines is disposed in a line along the body (such as body 102, 302) of the airless hairdryer (such as airless hairdryer 100, 300) the adjacent tine 205B may be the next tine located in the line. In some embodiments, such as when the plurality of tines is arranged in an array (as shown in FIGS. 3C-3D and 4A-5C), the adjacent tine 205B may be any or all tines directly next to the one tine 205B. In such embodiments, adjacent tine 205B may be the tine at any of eight cardinal directions from the one tine 205A. In some embodiments, one tine 205A may have multiple adjacent tines 205B. When the plurality of tines are arranged in an array, the adjacent tine 205B may be a tine in a same row of the array, a same column of the array, a same diagonal line of the array, or a combination thereof.

In some embodiments, the tines 205A, 205B each include a positive electrode 110A-i, 110A-ii, and a negative electrode 110B-i, 110B-ii. In some embodiments, the positive electrodes 110A-i, 110A-ii, are alternated with the negative electrodes 110B-i, 110B-ii. In some embodiments, the orientation of the positive electrodes 110A-i, 110A-ii and the negative electrodes 110B-i, 110B-ii determines which tine is the adjacent tine when the plurality of tines are arranged in an array. For example, if the positive electrodes 110A-i, 110A-ii and the negative electrodes 110B-i, 110B-ii are arranged in a southwest to northeast diagonal line inside (or on) each tine of the plurality of tines, the adjacent tines 205B are the tine directly to the southwest of the one tine 205A and the tine directly northeast of the one tine 205A. In some embodiments, a current source (such as current source 135 in FIGS. 1A-1B) is configured to supply a current to each electrode 110A-i, 110A-ii, 110B-i, 110B-ii in the plurality of tines to generate an alternating electric field EF between one electrode (such as negative electrode 110B-i) in the one tine 205A and a second electrode (such as positive electrode 110A-ii) in the adjacent tine 205B. While the alternating electric field EF is illustrated as being generated between the negative electrode 110B-i of the one tine 205A and the positive electrode 110A-ii of the adjacent tine 205B, it should be understood that the alternating electric field could be between the positive electrode 110A-i of the one tine 205A and the negative electrode 110B-ii of the adjacent tine 205B depending on the orientation of the electrodes 110A-i, 110A-ii, 110B-i, 110B-ii and/or the orientation of the one tine 205A and the adjacent tine 205B.

In some embodiments, the electrodes 110A-i, 110A-ii, 110B-i, 110B-ii are located inside each tine of the plurality of tines. In some embodiments, the electrodes 110A-i, 110A-ii, 110B-i, 110B-ii are located on the surface of each tine. In some embodiments, the electrodes 110A-i, 110A-ii, 110B-i, 110B-ii are contacts, such as copper contacts.

In some embodiments, the one tine 205A and the adjacent tine 205B are separated by a distance D. In some embodiments, each tine of the plurality of tines is separated by distance D. In some embodiments, the distance D is the maximum distance the tines may be apart to still generate the alternating electric field EF. In other embodiments, the distance D is any distance apart that generates the alternating electric field EF. In some embodiments, the alternating electric field EF is 1-300 MHz in frequency. In some embodiments, alternating electric field EF is a radiofrequency (RF) field.

Figure 2B:
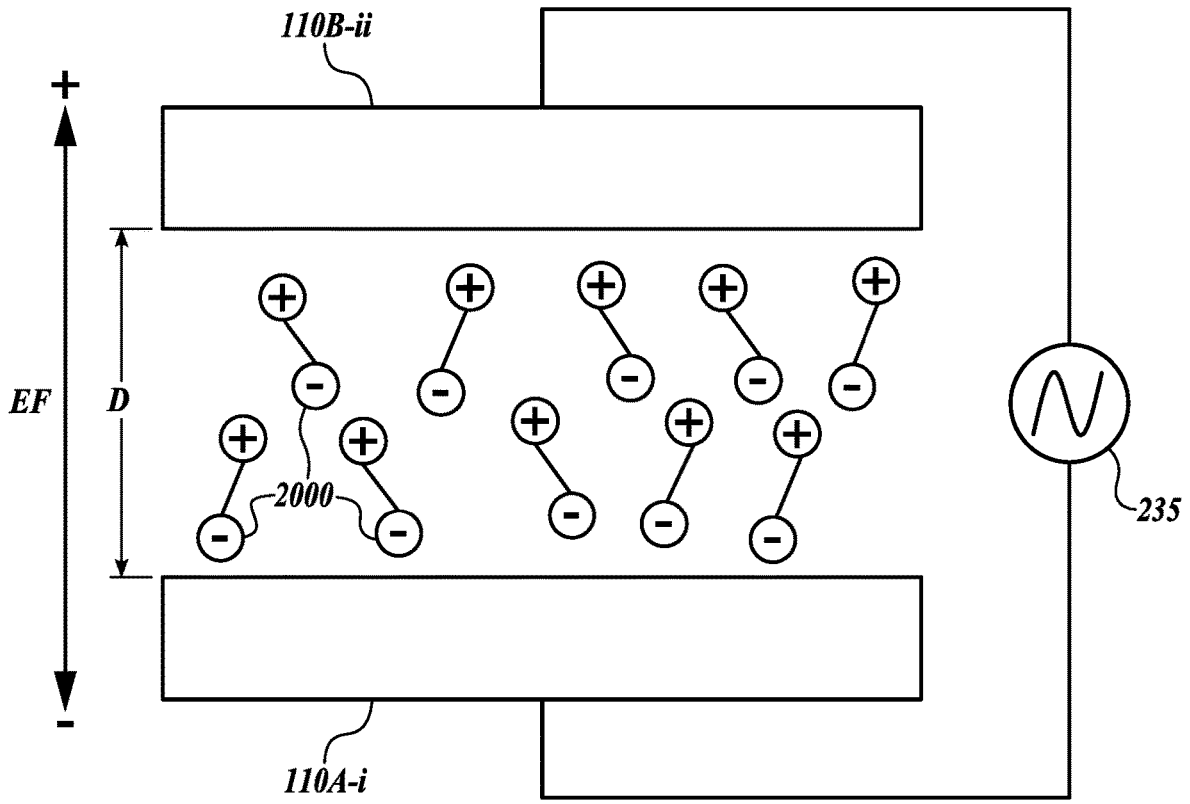
FIG. 2B is a close-up view of a positive electrode of one tine and a negative electrode of an adjacent tine, in accordance with the present technology.

FIG. 2B is a close-up view of a positive electrode 110A-i of one tine (such as one tine 205A) and a negative electrode 110B-ii of an adjacent tine (such as adjacent tine 205B), in accordance with the present technology. In some embodiments, the distance D may be substantially equal to the distance between the positive electrode 110A-i of one tine and the negative electrode 110B-ii of another tine (adjacent tine), such as when the electrodes 110A-i, 110B-ii are located on the outside of each tine.

In some embodiments, the alternating electric field EF is generated between the positive electrode 110A-i of one tine and the negative electrode 110B-ii of an adjacent electrode. In some embodiments, the alternating electric field EF is between 1-300 MHz in frequency.

In operation, the current source 235 supplies a current to the electrodes 110A-i, 110B-ii. The electrodes 110A-i, 110B-ii may generate an alternating electric field EF between them. The alternating energy of the alternating electric field EF may cause polar molecules in water to continuously re-orient them to face opposite poles, much in the way magnets move in an alternating magnetic field. In this manner, hair strands 2000 (illustrated as having positive (plus sign) and negative (minus sign) poles) may orient towards the electrodes 110A-i, 110B-ii. In this manner, the movement of the polar molecules in the water causes friction, which allows the water in the hair strands 2000 to rapidly evaporate through the hair strands 2000, effectively drying the hair.

Figure 3B:
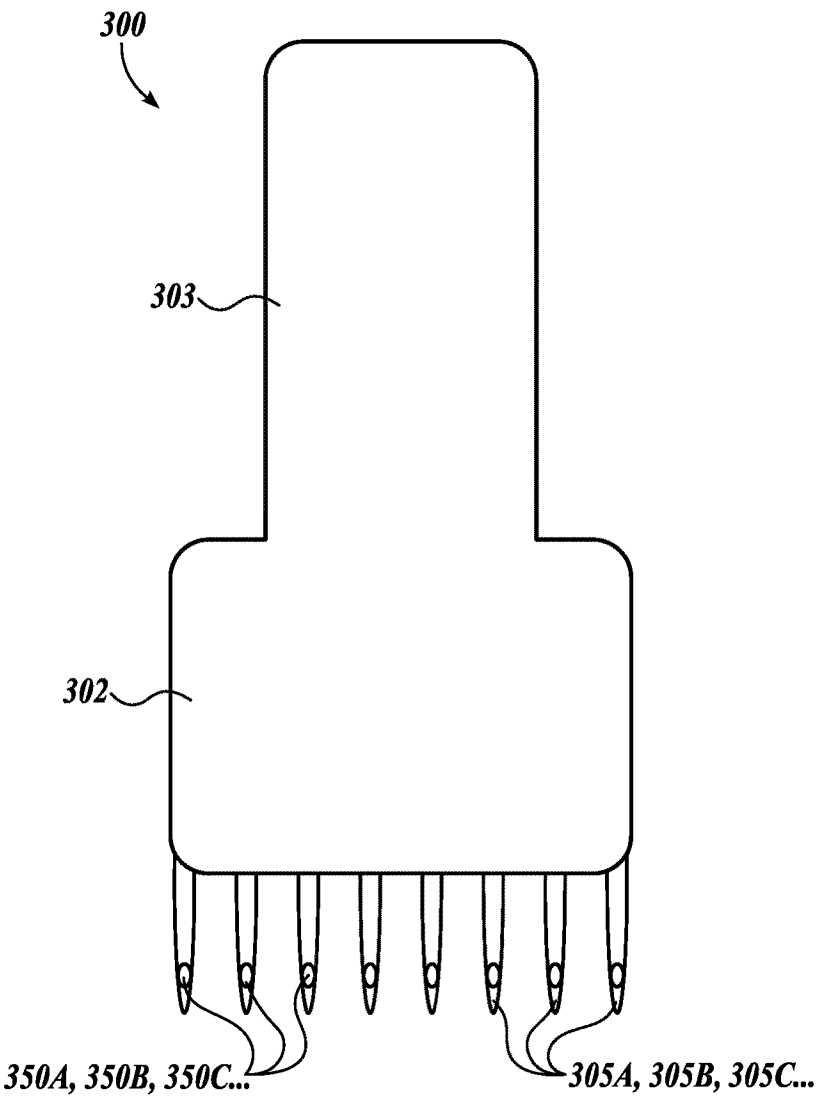
FIGS. 3A-3D are perspective views of example airless hairdryers, in accordance with the present technology.
Figure 3A:
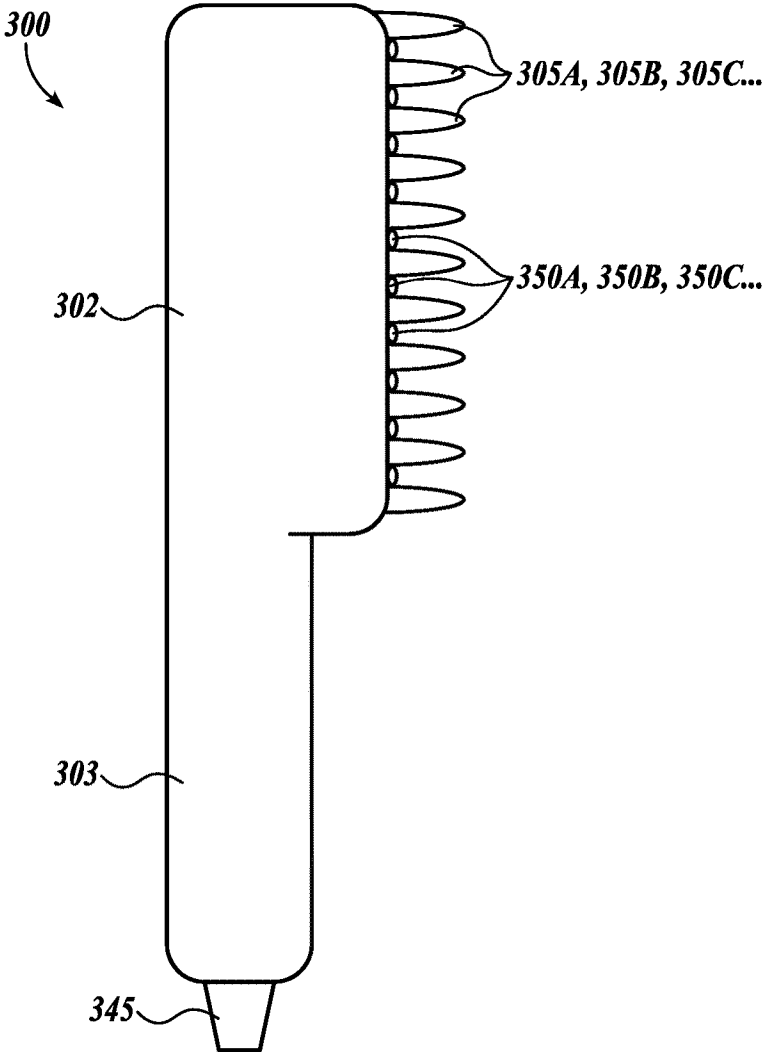
Figure 3D:
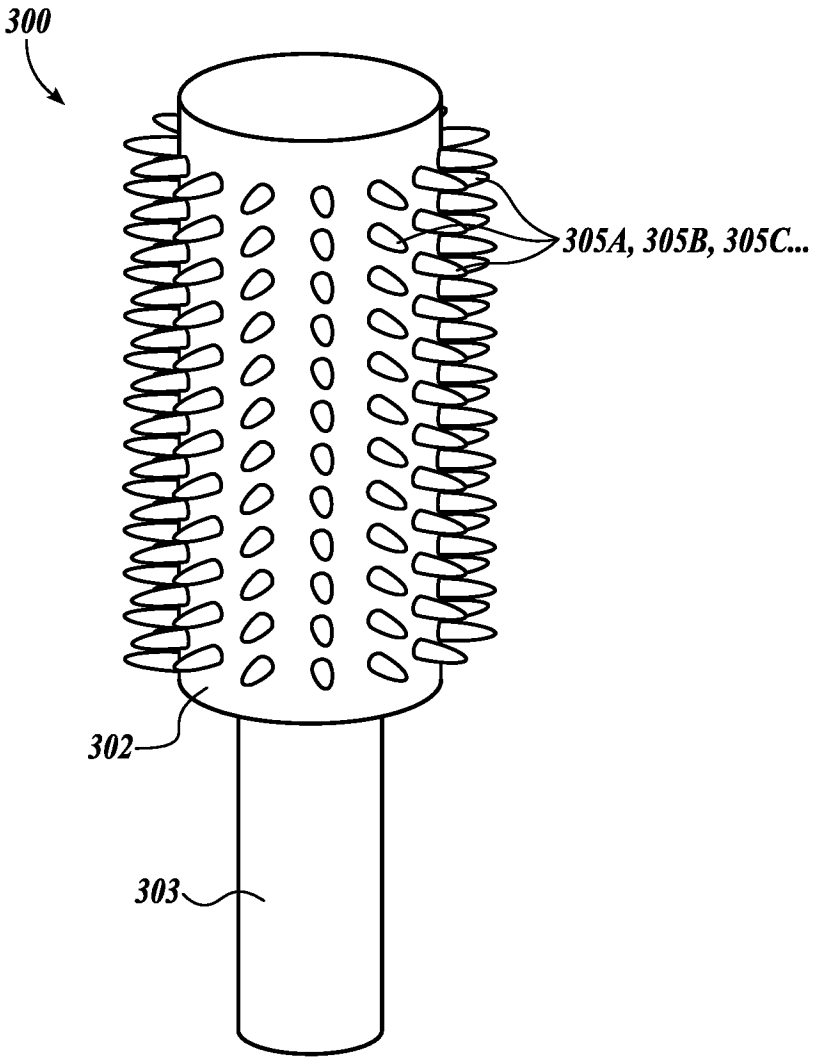
Figure 3C:
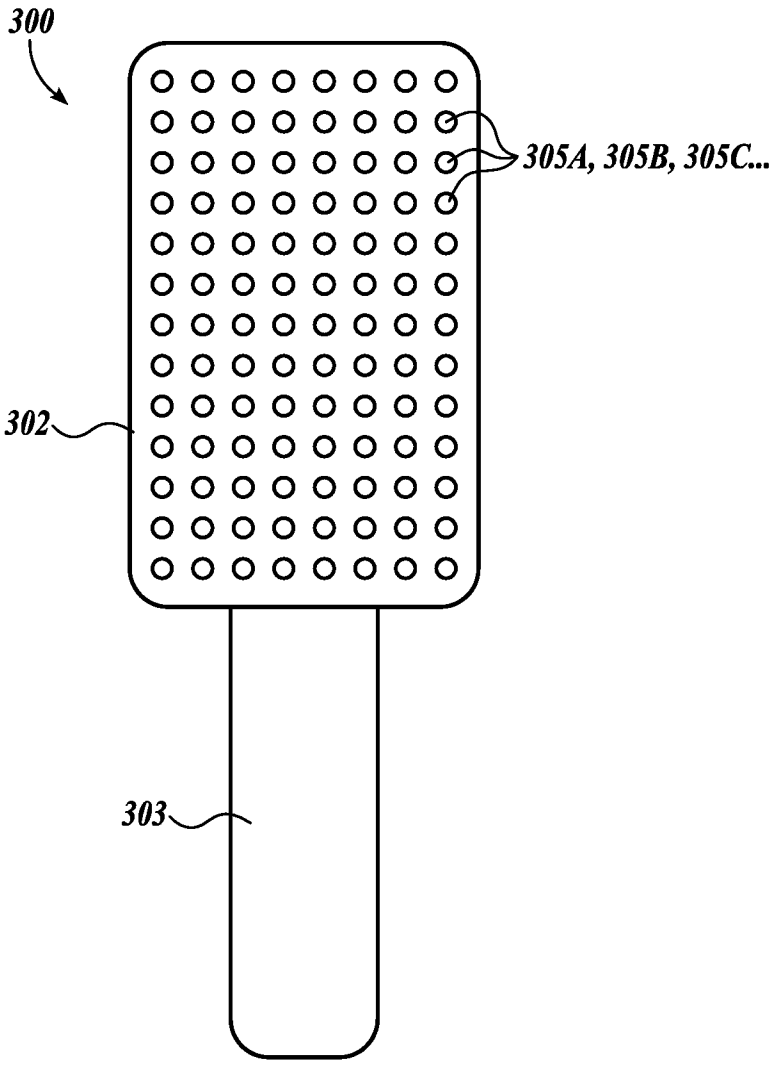

FIGS. 3A-3D are perspective views of example airless hairdryers 300, in accordance with the present technology. In some embodiments, the airless hairdryer 300 includes a body 302, a handle 303, and a plurality of tines 305A, 305B, 305C . . . 305N. In some embodiments, the handle 303 may be an integrated part of the body 302, such as shown in FIGS. 3A-3B. In some embodiments, the handle 303 may be a separate component from the body 302, as shown in FIGS. 3C-3D. One skilled in the art should recognize than any configuration of handle could be incorporated into any form factor of the airless hairdryer 300 including a single body/handle component 302, 303, a separate handle 303, a handle 303 removable from the body 302, or the like. The handle 303 may have any shape, including two-dimensional, three-dimensional, cylindrical, rectangular, organic shaped, or the like.

In some embodiments, the plurality of tines 305A, 305B, 305C . . . 305N are arranged in a line along all or a portion of the body 302, such as shown in FIGS. 3A-3B. In some embodiments, the airless hairdryer 300 includes a plurality of infrared (IR) light-emitting diodes (LEDs) 350A, 350B, 350C.

In operation, the IR LEDs 350A, 350B, 350C are configured to radiate or transfer IR energy to the hair. In some embodiments, the IR energy has a wavelength between 0.78 and 1000 μm. In some embodiments, the IR energy is short wave IR (about 0.78 to 2 μm), medium wave IR (about 2 to 4 μm), and/or long wave IR (about 4 to 1000 μm). In some embodiments, the IR LEDs 350A, 350B, 350C are configured to dry the hair while alternating electric fields are generated between the plurality of tines (as described in FIGS. 2A-2B). In some embodiments, the IR LEDs 350A, 350B, 350C are configured to dry the hair independently from the alternating electric fields, such as before the alternating electric fields are generated, after the alternating electric fields are generated, or both. In some embodiments, the alternating electric fields and the IR LEDS 350A, 350B, 350C are alternated as a user moves the airless hairdryer 300 through hair. In some embodiments, a vapor sensor (such as vapor sensor 120) detects a dryness level of the hair, and when the dryness level meets or exceeds a dryness level, the alternating electric fields are turned off and the IR LEDs 350A, 350B, 350C are turned on.

FIG. 3A is an airless hairdryer 300 having a "comb with a handle" form factor. In some embodiments, the airless hairdryer 300 includes a power connector 345 configured to facilitate a wired connection (not shown) with an outlet or external power source. In some embodiments, the power connector 345 may be communicatively or physically connected to a power source (such as power source 140) inside the airless hairdryer 300. In some embodiments, the power connector 345 supplies power to the power source to power the airless hairdryer 300. In some embodiments, the plurality of IR LEDs 350A, 350B, 350C are located between each tine of the plurality of tines 305A, 305B, 305C. In such embodiments, the IR LEDs 350A, 350B, 350C may dry the hair as it is brushed or combed through the plurality of tines 305A, 305B, 305C.

FIG. 3B is an airless hairdryer 300 having a "hair pick" form factor. In some embodiments, the IR LEDs 350A, 350B, 350C are located inside or on each tine of the plurality of tines 305A, 305B, 305C. In some embodiments, the IR LEDS 305A, 305B, 305C are configured to dry the hair as the plurality of tines 305A, 305B, 305C contact the hair.

In some embodiments, the plurality of tines 305A, 305B, 305C is arranged in an array, as shown in FIGS. 3C-3D. As explained in FIGS. 2A-2B, the alternating electric fields may be generated between any two adjacent tines in the plurality of tines 305A, 305B, 305C. In some embodiments, the alternating electric fields may be generated between any number of adjacent tines along a line, such as a north-south line, an east-west line, a southwest-northeast line, or a northwest-southwest line. In some embodiments, the alternating electric field is generated between tines located in a same row, a same column, or a same diagonal of the array.

FIG. 3C is an airless hairdryer 300 having a "hairbrush" form factor, while FIG. 3D is an airless hairdryer 300 having a "barrel hairbrush" form factor. In some embodiments, the body 302 is barrel shaped, as shown in FIG. 3D.

Figure 4C:
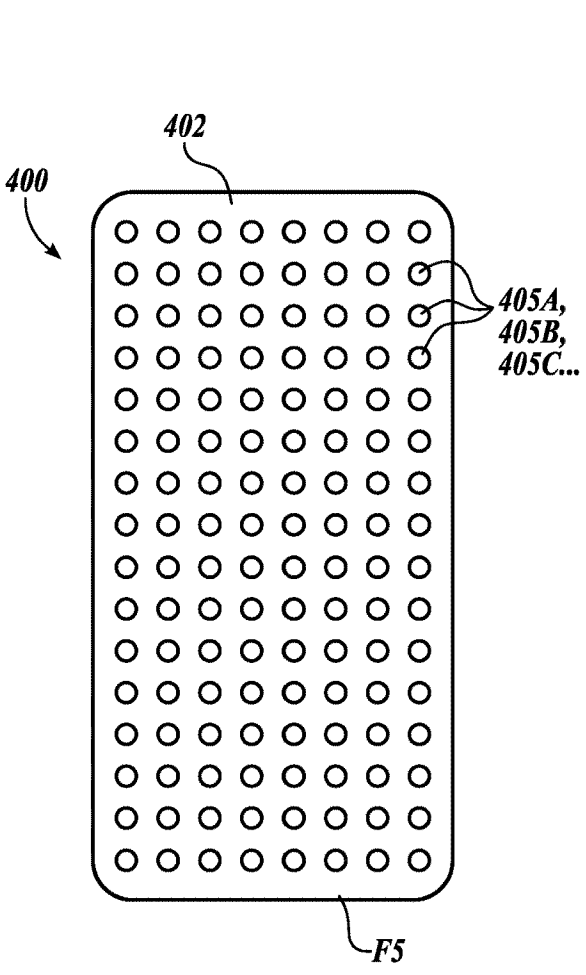
FIG. 4C is one face of the airless hairdryer of FIG. 4A, in accordance with the present technology.
Figure 4B:
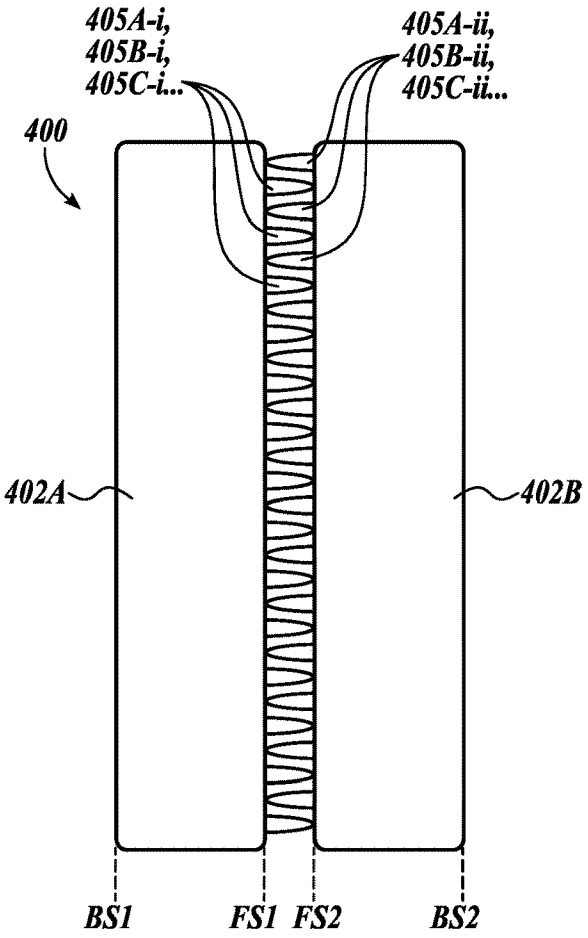
FIG. 4B shows the first face and the second face of the airless hairdryer of FIG. 4A in contact with one another, in accordance with the present technology.
Figure 4A:
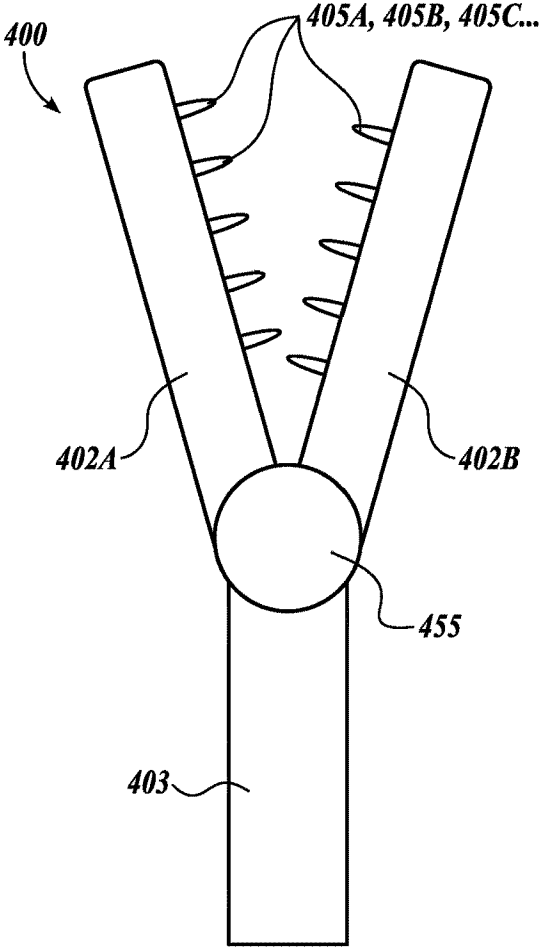
FIG. 4A is an example airless hairdryer having a first face and a second face, in accordance with the present technology.

FIG. 4A is an example airless hairdryer 400 having a first face 402A and a second face 402B, in accordance with the present technology. In some embodiments, the airless hairdryer 400 has a body made up of a first face 402A and a second face 402B. In some embodiments, the airless hairdryer 400 further includes a clamping mechanism (or clamp) 455. In some embodiments, the airless hairdryer 400 includes a handle 403, but this may be omitted in other embodiments.

In some embodiments, the first face 402A, the second face 402B, or both include a plurality of tines 405A, 405B, 405C. In some embodiments, the term "plurality of tines" includes every tine located on the airless hairdryer 400.

In some embodiments, the airless hairdryer 400 includes a clamp 555. In some embodiments, the clamp 455 is a hinge, a brace, a band, a clasp, or another clamping mechanism. In some embodiments, the clamp 455 is configured to bring a frontside of the first face 402A towards a frontside of the second face 402B, as shown in FIG. 4B. In some embodiments, the clamp 455 is electronically powered to automatically clamp the first face 402A and the second face 402B. In some embodiments, the clamp 455 is manual, and the first face 402A and the second face 402B may be brought into contact by a machine, or the user, such as by a squeezing motion of the user's hands. In some embodiments, both the first face 402A and the second face 402B may move towards a center of the airless hairdryer 400 to come into contact with one another. In other embodiments, either the first face 402A or the second face 402B may be stationary, and the other of the first face 402A or the second face 402B may move towards the stationary face.

FIG. 4B shows the first face 402A and the second face 402B of the airless hairdryer 400 of FIG. 4A in contact with one another, in accordance with the present technology. In some embodiments, the first face 402A includes a frontside FS1 and a backside FS2. Similarly, the second face 402B may have a frontside FS2 and a backside BS2. In some embodiments, a first plurality of tines 405A-i, 405B-i, 405C-i is located on the frontside FS1 of the first face 402A, and a second plurality of tines 405A-ii, 405B-ii, 405C-ii is located on the frontside FS2 of the second face 402B. In some embodiments, the first plurality of tines 405A-i, 405B-i, 405C-I and the second plurality of tines 405A-ii, 405B-ii, 405C-ii are arranged so that they alternate when the first face 402A and the second face 402B are brought together. In some embodiments, the adjacent tine as described in FIGS. 2A-2B may be a tine from the other face that becomes an adjacent tine when the two faces 402A, 402B are brought towards one another. While both the front side FS1 of the first face 402A and the front side FS2 of the second face 402B are illustrated as having a plurality of tines (the first plurality of tines 405A-i, 405B-i, 405C-I and the second plurality of tines 405A-ii, 405B-ii, 405-*ii*) it should be understood that in some embodiments, only one face 402A, 402B has a plurality of tines.

In operation, as the first face 402A and the second face 402B are brought together, the first plurality of tines 405A-i, 405B-i, 405C-I and the second plurality of tines 405A-ii, 405B-ii, 405-ii interlock. A current source (such as current source 135, 235) may deliver a current to the first plurality of tines 405A-i, 405B-i, 405C-I and the second plurality of tines 405A-ii, 405B-ii, 405-ii. In some embodiments, alternating electric fields are generated between adjacent tines. In some embodiments, the first plurality of tines 405A-i, 405B-i, 405C-I and the second plurality of tines 405A-ii, 405B-ii, 405-ii may generate alternating electric fields independently, that it, first alternating electric fields may be generated between each tine of first plurality of tines 405A-i, 405B-i, 405C-i and second alternating electric fields may be generated between each tine of the second plurality of tines 405A-ii, 405B-ii, 405-ii. In some embodiments, the first plurality of tines 405A-i, 405B-i, 405C-i and the second plurality of tines 405A-ii, 405B-ii, 405-ii generate alternating electric fields together, that is alternating electric fields are generated between one tine of the first plurality of tines 405A-i, 405B-i, 405C-i and one tine of the second plurality of tines 405A-ii, 405B-ii, 405-ii.

FIG. 4C is one face 402 of the airless hairdryer 400 of FIG. 4A, in accordance with the present technology. Face 402 may be a first face (such as first face 402A) or a second face (such as second face 402B). In some embodiments, both the first face and the second face are substantially the same. In some embodiments, the first face and the second face are different. For example, in some embodiments, the first face may have a plurality of tines, while the second face may not. In some embodiments, the face 402 includes a plurality of tines 405A, 405B, 405C. In some embodiments, the plurality of tines 405A, 405B, 405C are arranged in an array, as shown in FIG. 4C.

Figure 5C:
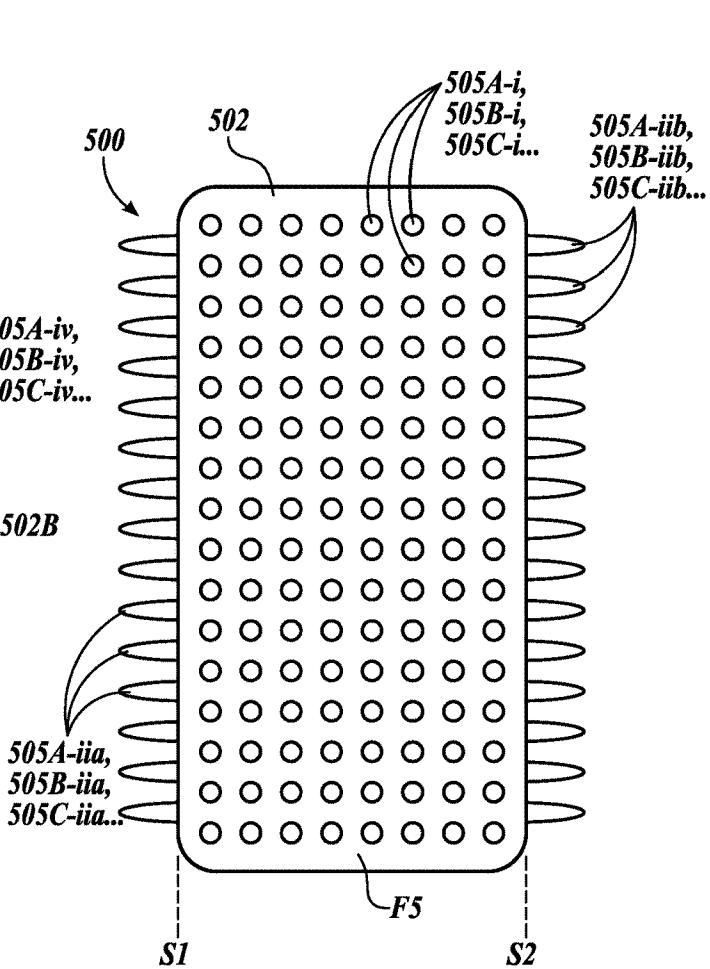
FIG. 5C is one face of the airless hairdryer of FIG. 5A, in accordance with the present technology.
Figure 5B:
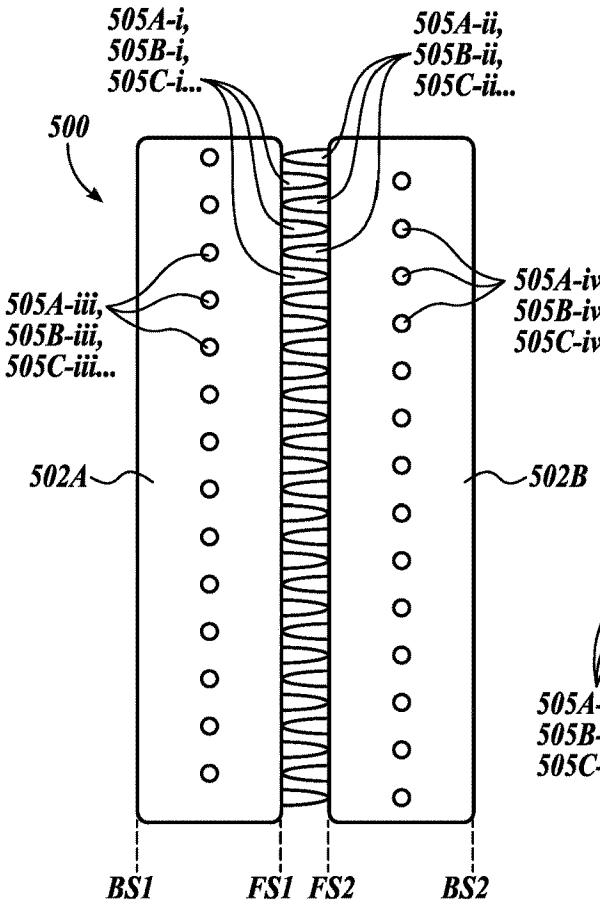
FIG. 5B shows the first face and the second face of the airless hairdryer of FIG. 5A in contact with one another, in accordance with the present technology.
Figure 5A:
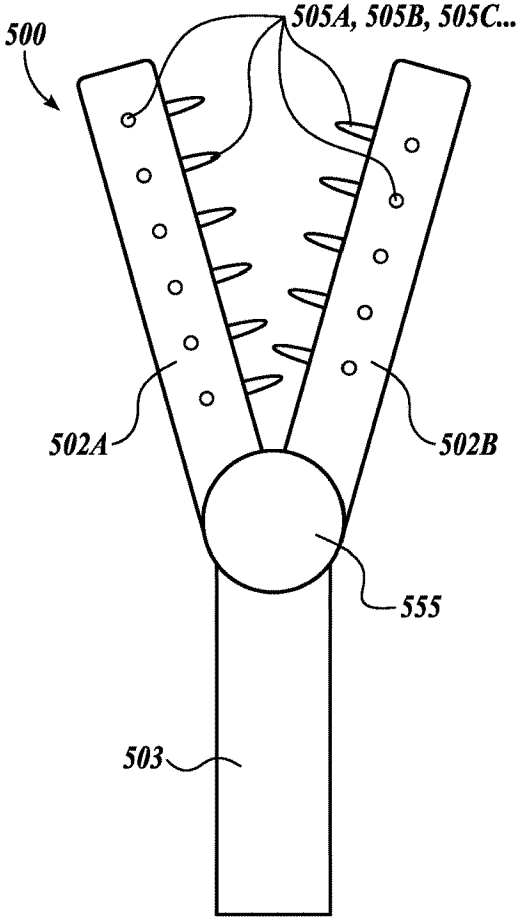
FIG. 5A is another example airless hairdryer having a first face and a second face, in accordance with the present technology.

FIG. 5A is another example airless hairdryer 500 having a first face 502A and a second face 502B, in accordance with the present technology. In some embodiments, the airless hairdryer 500 has a body made up of a first face 502A and a second face 502B and a clamping mechanism (or clamp) 555. In some embodiments, the airless hairdryer 500 includes a handle 503, but this may be omitted in other embodiments.

In some embodiments, the first face 502A, the second face 502B, or both include a plurality of tines 505A, 505B, 505C. In some embodiments, the term "plurality of tines" includes every tine located on an airless hairdryer 500.

In some embodiments, the airless hairdryer 500 includes a clamp 555. In some embodiments, the clamp 555 is a hinge, a brace, a band, a clasp, or another clamping mechanism. In some embodiments, the clamp 555 is configured to bring a frontside of the first face 502A towards a frontside of the second face 502B, as described herein.

FIG. 5B shows the first face 502A and the second face 502B of the airless hairdryer 500 of FIG. 5A in contact with one another, in accordance with the present technology. In some embodiments, the first face 502A includes a frontside FS1 and a backside FS2. Similarly, the second face 502B may have a frontside FS2 and a backside BS2. In some embodiments, a first plurality of tines 505A-i, 505B-i, 505C-i is located on the frontside FS1 of the first face 502A, and a second plurality of tines 505A-ii, 505B-ii, 505C-ii is located on the frontside FS2 of the second face 502B. In some embodiments, the first plurality of tines 505A-i, 505B-i, 505C-I and the second plurality of tines 505A-ii, 505B-ii, 505C-ii are arranged so that they alternate when the first face 502A and the second face 502B are brought together. In some embodiments, the adjacent tine as described in FIGS. 2A-2B may be a tine from the other face that becomes an adjacent tine when the two faces 502A, 502B are brought towards one another. In some embodiments, the airless hairdryer 500 includes a third plurality of tines 505A-iii, 505B-iii, 505C-iii located on one or more sides of the first face 502A (as shown more clearly in FIG. 5C) and a fourth plurality of tines 505A-iv, 505B-iv, 505C-iv located on one or more sides of the second face 502A (as shown more clearly in FIG. 5C). In some embodiments, the third plurality of tines 505A-iii, 505B-iii, 505C-iii, and the fourth plurality of tines 505A-iv, 505B-iv, 505C-iv only generate an alternating electric fields amongst themselves, that is, only between tines of the third plurality of tines 505A-iii, 505B-iii, 505C-iii or only between tines of the fourth plurality of tines 505A-iv, 505B-iv, 505C-iv.

While the front side FS1 of the first face 502A, the front side FS2 of the second face 502B, one or more sides of the first face 502A, and one or more sides of the second face 502B are illustrated as having a plurality of tines (the first plurality of tines 505A-i, 505B-i, 505C-i, the second plurality of tines 505A-ii, 505B-ii, 505-*ii*, the third plurality of tines 505A-iii, 505B-iii, 505C-iii, and the fourth plurality of tines 505A-iv, 505B-iv, 505C-iv) it should be understood that in some embodiments, only one face 502A, 502B has one or more plurality of tines. Further, in some embodiments, one face of the first face 502A or the second face 502B may have one plurality of tines and one face of the first face 502A or the second face 502B may have one plurality of tines. For example, the first face 502A may have the first plurality of tines 505A-i, 505B-i, 505C-i and the second face 502B may have the fourth plurality of tines 505A-iv, 505B-iv, 505C-iv.

In operation, the first face 502A and the second face 502B may be clamped together (such as with clamp 555). In some embodiments, a user may move the first face 502A and the second face 502B, while they are clamped together, over hair. The alternating electric fields generated between the first plurality of tines 505A-i, 505B-i, 505C-i and the second plurality of tines 505A-ii, 505B-ii, 505-*ii* (either independently or together) may dry the hair. In some embodiments, while the first face 502A and the second face 502B are clamped together, the user may roll the airless hairdryer 500, such as in a curling motion, so that hair is also disposed between the third plurality of tines 505A-iii, 505B-iii, 505C-iii, and/or the fourth plurality of tines 505A-iv, 505B-iv, 505C-iv. As shown in FIG. 5C, in some embodiments, this curling motion may be done in either direction as there is a plurality of tines (first second plurality of tines 505A-iia, 505B-iia, 505C-iia and another second plurality of tines 505A-iib, 505B-iib, 505C-iib, respectively) located on both sides (S1, S2) of one or more of the faces 502A, 502B. In some embodiments, the user may unclamp the first face 502A and the second face 502B from the hair and brush through the hair with the third plurality of tines 505A-iii, 505B-iii, 505C-iii, and/or the fourth plurality of tines 505A-iv, 505B-iv, 505C-iv only to dry the hair.

FIG. 5C is one face 502 of the airless hairdryer 500 of FIG. 5A, in accordance with the present technology. Face 502 may be a first face (such as first face 502A) or a second face (such as second face 502B). In some embodiments, both the first face and the second face are substantially the same. In some embodiments, the first face and the second face may be different. For example, in some embodiments, the first face may have a plurality of tines, while the second face may not. In some embodiments, the face 502 includes a first plurality of tines 505A-i, 505B-i, 505C-i. In some embodiments, the first plurality of tines 505A-i, 505B-i, 505C-i is arranged in an array, as shown in FIG. 4C. In some embodiments, the face 502 includes a first side S1 and a second side S2. In some embodiments, the face 502 has a first second plurality of tines 505A-iia, 505B-iia, 505C-iia located on a first side S1. In some embodiments, the first second plurality of tines 505A-iia, 505B-iia, 505C-iia are arranged in a line. In some embodiments, the face 502 has another second plurality of tines 505A-iib, 505B-iib, 505C-iib located on the second side S2. In some embodiments, the another second plurality of tines 505A-iib, 505B-iib, 505C-iib is arranged in a line. While both the first second plurality of tines 505A-iia, 505B-iia, 505C-iia and the another second plurality of tines 505A-iib, 505B-iib, 505C-iib are illustrated, it should be understood that in some embodiments, only the first second plurality of tines 505A-iia, 505B-iia, 505C-iia or the another second plurality of tines 505A-iib, 505B-iib, 505C-iib may be included.

Figure 6A:
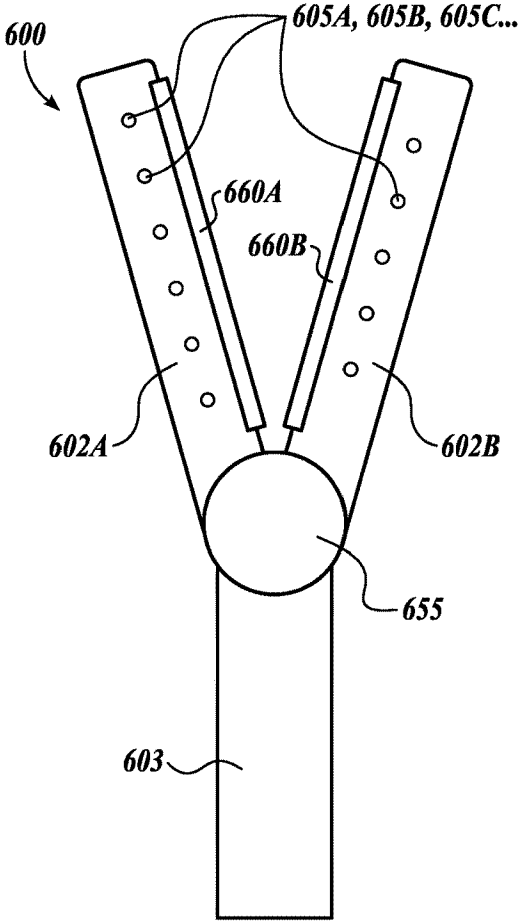
FIG. 6A is another example airless hairdryer having a first face and a second face, in accordance with the present technology.

FIG. 6A is another example airless hairdryer 600 having a first face 602A and a second face 602B, in accordance with the present technology. In some embodiments, the airless hairdryer 600 has a body made up of a first face 602A and a second face 602B, and a clamping mechanism (or clamp) 655. In some embodiments, the airless hairdryer 600 includes a handle 603, but this may be omitted in other embodiments. In some embodiments, the first face 602A includes a first heating plate 660A, and the second face 602B includes a second heating plate 660B. In some embodiments, the first heating plate 660A and the second heating plate 660B are iron plates, IR LEDs, or other such heating elements.

Figure 6B:
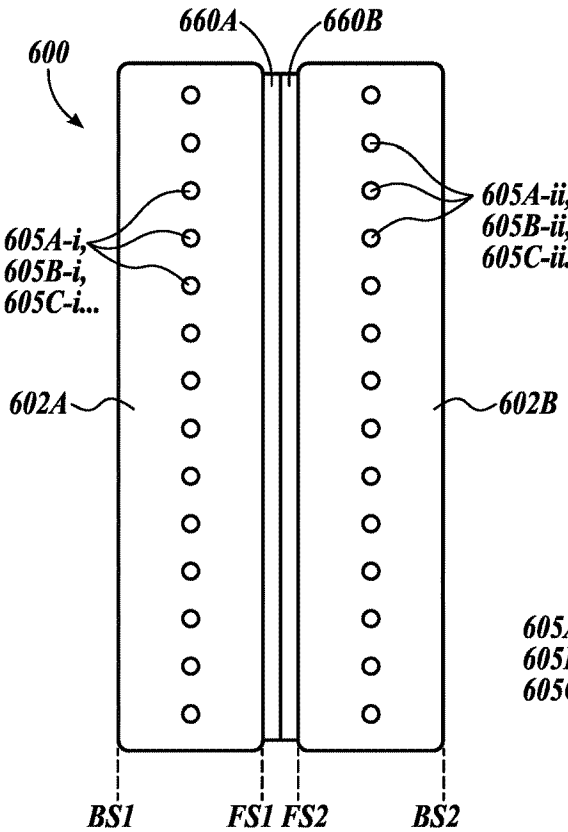
FIG. 6B shows the first face and the second face of the airless hairdryer of FIG. 6A in contact with one another, in accordance with the present technology.

FIG. 6B shows the first face 602A and the second face 602B of the airless hairdryer 600 of FIG. 6A in contact with one another, in accordance with the present technology. In some embodiments, the first face 602A includes a frontside FS1 and a backside FS2. Similarly, the second face 602B may have a frontside FS2 and a backside BS2. In some embodiments, the first heating plate 660A is located on the front side FS1 of the first face 602A and the second heating plate 660B is located on the frontside FS2 of the second face 602B.

In some embodiments, the airless hairdryer 600 includes a first plurality of tines 605A-i, 605B-i, 605C-i located on one or more sides of the first face 602A (as shown more clearly in FIG. 6C) and a second plurality of tines 605A-ii, 605B-ii, 605C-ii located on one or more sides of the second face 502A (as shown more clearly in FIG. 5C). In some embodiments, the first plurality of tines 605A-i, 605B-i, 605C-i and the second plurality of tines 605A-ii, 605B-ii, 605C-ii only generate alternating electric fields amongst themselves, that is, only between tines of the first plurality of tines 605A-i, 605B-i, 605C-i or only between tines of the second plurality of tines 605A-ii, 605B-ii, 605C-ii.

Figure 6C:
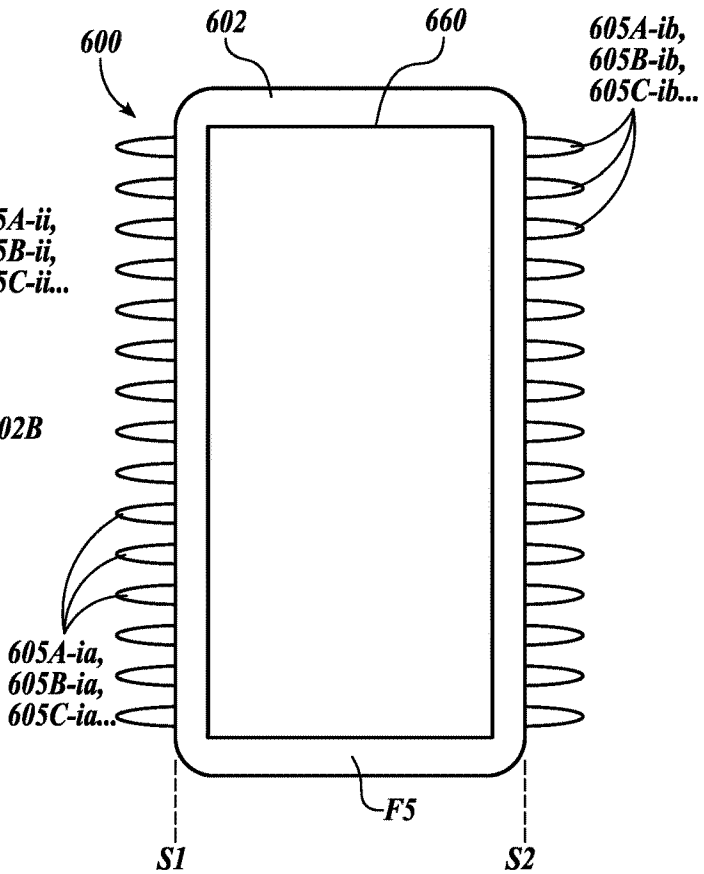
FIG. 6C is one face of the airless hairdryer of FIG. 6A, in accordance with the present technology.

In operation, the first face 602A and the second face 602B may be clamped together (such as with clamp 655). In some embodiments, a user may move the first face 602A and the second face 602B, while they are clamped together, over hair. The first heating plate 660A, the second heating plate 660B, or a combination thereof may dry the hair. In some embodiments, while the first face 602A and the second face 602B are clamped together, the user may roll or turn the airless hairdryer 600, such as in a curling motion, so that hair is also disposed between the first plurality of tines 605A-i, 605B-i, 605C-i and/or the second plurality of tines 605A-ii, 605B-ii, 605C-ii. As shown in FIG. 6C, in some embodiments, this curling motion may be done in either direction as there is a plurality of tines (a first side first plurality of tines 605A-ia, 605B-ia, 605C-ia and a second side first plurality of tines 605A-ib, 605B-ib, 605C-ib) located on both sides (S1, S2) of one or more of the faces 602A, 602B. In some embodiments, the user may unclamp the first face 602A and the second face 602B from the hair and brush through the hair with the first plurality of tines 605A-i, 605B-i, 605C-i and/or the second plurality of tines 605A-ii, 605B-ii, 605C-ii to dry the hair.

FIG. 6C is one face 602 of the airless hairdryer 600 of FIG. 6A, in accordance with the present technology. Face 602 may be a first face (such as first face 602A) or a second face (such as second face 602B). In some embodiments, both the first face and the second face are substantially the same. In some embodiments, the first face and the second face may be different. For example, in some embodiments, the first face may have a plurality of tines, while the second face may not. As another example, the first face may have a heating plate, while the second face may not. In some embodiments, a heating plate 660 is located on a front side FS of the face 602. In some embodiments, the face 602 includes a first side S1 and a second side S2. In some embodiments, the face 602 has a first side first plurality of tines 605A-ia, 605B-ia, 605C-ia located on the first side S1. In some embodiments, the first side first plurality of tines 605A-ia, 605B-ia, 605C-ia are arranged in a line. In some embodiments, the face 602 has and a second side first plurality of tines 605A-ib, 605B-ib, 605C-ib located on the second side S2. In some embodiments, the second side first plurality of tines 605A-ib, 605B-ib, 605C-ib is arranged in a line. While both the first side first plurality of tines 605A-ia, 605B-ia, 605C-ia and the second side first plurality of tines 605A-ib, 605B-ib, 605C-ib are illustrated, it should be understood that in some embodiments, only the first side first plurality of tines 605A-ia, 605B-ia, 605C-ia or the second side first plurality of tines 605A-ib, 605B-ib, 605C-ib may be included.

Figure 7:
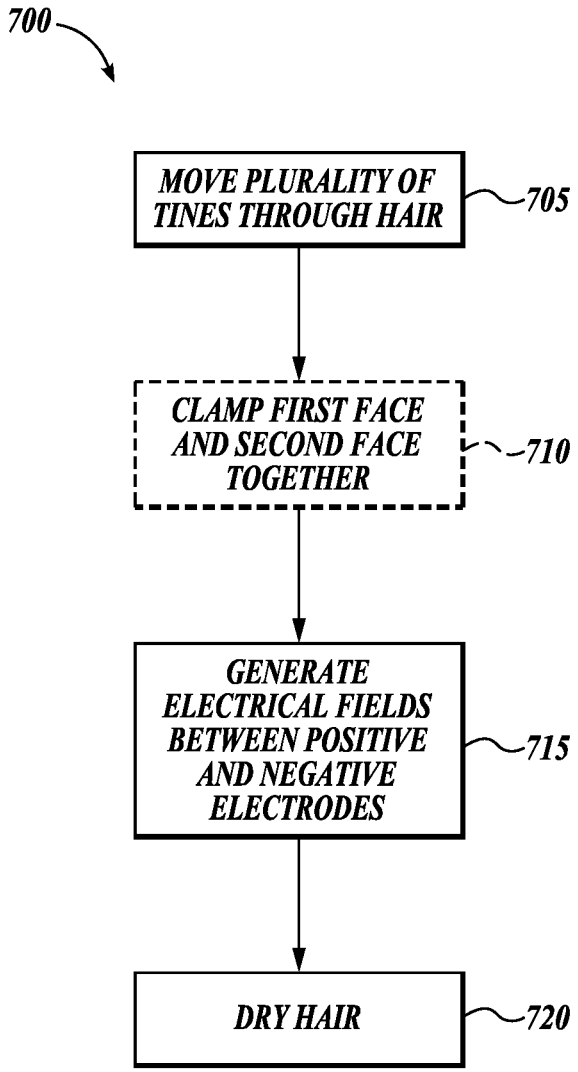
FIG. 7 is an example method of using an airless hairdryer, in accordance with the present technology.

FIG. 7 is an example method 700 of using an airless hairdryer, in accordance with the present technology. The method 700 may be performed by any of the airless hairdryers (100, 200, 300, 400, 500, 600) described herein. In some embodiments, the airless hairdryer includes a body (such as body 102, 302, 402, 502, 602) and at least one plurality of tines (such as plurality of tines 105A, 105B, 105C . . . 105N, 205A, 205B, 305A, 305B, 305C, 405A, 405B, 405C, 505A, 505B, 505C, 605A, 605B, 605C). In some embodiments, the airless hairdryer also includes a processor (such as processor 130), a current source (such as current source 135, 235) and/or a power source (such as power source 140). In some embodiments, the airless hairdryer also includes one or more temperature sensors (such as temperature sensor 115), one or more proximity sensors (such as proximity sensor 125), one or more vapor sensors (such as vapor sensor 120 and/or plurality of vapor sensors 120A, 120B, 120C . . . 120N), and/or one or more infrared light-emitting diodes (IR LEDs) (such as plurality of IR LEDs 350A, 350B, 350C).

In block 705, the plurality of tines is moved through hair (or hair strands, such as hair strands 2000). In some embodiments, the plurality of tines is located on the body of the airless hairdryer. The body may have a first face (such a first face 402A, 502A, 602A) and/or a second face (such as second face 402B, 502B, 602B). In some embodiments, the plurality of tines may be located on the first face and/or the second face, and on one or more sides (such as a frontside of the first face FS1, a frontside of the second face FS2, a first side S1, and/or a second side S2) of the first face and/or the second face.

Optionally, in block 710, the first face and the second face are clamped together (such as shown in FIGS. 4B, 5B, and 6B). In some embodiments, the plurality of tines on the first face interlock or alternate with the plurality of tines on the second face.

In block 715, electrical fields (also referred to herein as an alternating electrical fields) is generated between positive electrodes (such as positive electrodes 110A, 110A-i, 110A-ii) of one tine of the plurality of tines and negative electrodes (such as negative electrodes 110B, 110B-i, 110B-ii) of an adjacent tine of the plurality of tines. As described herein, an adjacent tine may refer to one or more tines of the plurality of tines directly next to another tine of the plurality of tines. When the plurality of tines is arranged in a line (as shown in FIGS. 1A-1B, 3A-3B, 5A-5C, and 6A-6C) the adjacent tine is one or more tines located directly on either side of a tine of the plurality of tines. When the plurality of tines is arranged in an array (as shown in FIGS. 3C-3D, 4A-4C, and 5A-5C) the adjacent tine may be one or more tines in any cardinal direction, along any line, such as within the same column or same row, or at a diagonal. When the airless hairdryer includes more than one plurality of tines (as shown in FIGS. 4A-4C, 5A-5C, and 6A-6C) the adjacent tine may be a tine of the same plurality of tines as the one tine, or a tine of another plurality of tines as the one tine.

In block 720, the hair is dried. In some embodiments, the current source supplies a current to the electrodes. The electrodes may generate alternating electric fields between them. The alternating energy of the alternating electric fields causes polar molecules in water to continuously re-orient them to face opposite poles, much in the way magnets move in an alternating magnetic field. In this manner, hair strands having positive and negative poles may orient towards the electrodes. In this manner, the movement of the polar molecules in the water causes friction, which allows the water in the hair strands to rapidly evaporate through the hair strands, effectively drying the hair.

Figure 8:
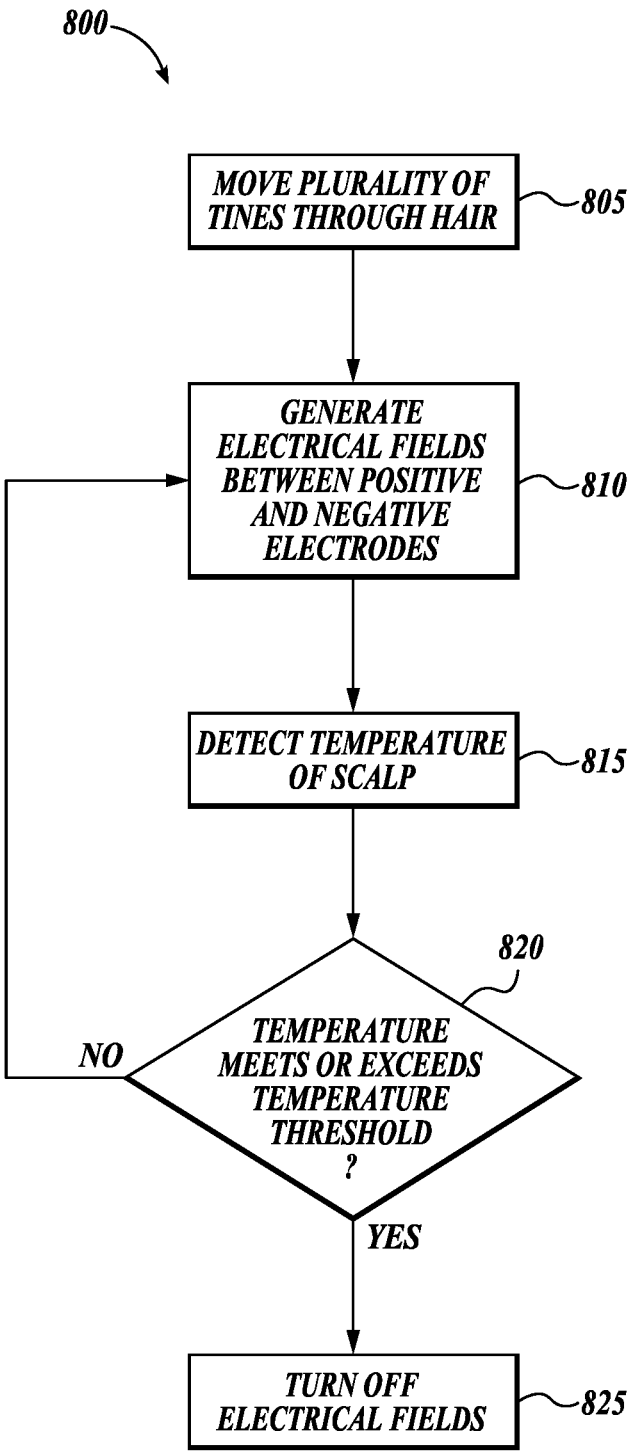
FIG. 8 is an example method of using an airless hairdryer with a temperature sensor, in accordance with the present technology.

FIG. 8 is an example method 800 of using an airless hairdryer with a temperature sensor, in accordance with the present technology. The method 800 may be performed by any of the airless hairdryers (100, 200, 300, 400, 500, 600) described herein. In some embodiments, the airless hairdryer includes a body (such as body 102, 302, 402, 502, 602) and at least one plurality of tines (such as plurality of tines 105A, 105B, 105C . . . 105N, 205A, 205B, 305A, 305B, 305C, 405A, 405B, 405C, 505A, 505B, 505C, 605A, 605B, 605C). In some embodiments, the airless hairdryer also includes a processor (such as processor 130), a current source (such as current source 135, 235) and/or a power source (such as power source 140). In some embodiments, the airless hairdryer also includes one or more temperature sensors (such as temperature sensor 115), one or more proximity sensors (such as proximity sensor 125), one or more vapor sensors (such as vapor sensor 120 and/or plurality of vapor sensors 120A, 120B, 120C . . . 120N), and/or one or more infrared light-emitting diodes (IR LEDs) (such as plurality of IR LEDs 350A, 350B, 350C).

In block 805, the plurality of tines is moved through hair (or hair strands, such as hair strands 2000). In some embodiments, the plurality of tines is located on the body of the airless hairdryer. The body may have a first face (such a first face 402A, 502A, 602A) and/or a second face (such as second face 402B, 502B, 602B). In some embodiments, the plurality of tines may be located on the first face and/or the second face, and on one or more sides (such as a frontside of the first face FS1, a frontside of the second face FS2, a first side S1, and/or a second side S2) of the first face and/or the second face.

In block 810, electrical fields (also referred to herein as an alternating electrical fields) are generated between positive electrodes (such as positive electrodes 110A, 110A-i, 110A-ii) of one tine of the plurality of tines and negative electrodes (such as negative electrodes 110B, 110B-i, 110B-ii) of an adjacent tine of the plurality of tines. As described herein, an adjacent tine may refer to one or more tines of the plurality of tines directly next to another tine of the plurality of tines.

When the plurality of tines is arranged in a line (as shown in FIGS. 1A-1B, 3A-3B, 5A-5C, and 6A-6C) the adjacent tine is one or more tines located directly on either side of a tine of the plurality of tines. When the plurality of tines is arranged in an array (as shown in FIGS. 3C-3D, 4A-4C, and 5A-5C) the adjacent tine may be one or more tines in any cardinal direction, along any line, such as within the same column or same row, or at a diagonal. When the airless hairdryer includes more than one plurality of tines (as shown in FIGS. 4A-4C, 5A-5C, and 6A-6C) the adjacent tine may be a tine of the same plurality of tines as the one tine, or a tine of another plurality of tines as the one tine.

In block 815, a temperature of a user's scalp is detected. In some embodiments, the temperature may be measured by the temperature sensor. In some embodiments, the temperature sensor may be located in one tine of the plurality of tines, or in the body of the airless hairdryer.

In decision block 820, it is determined whether the measured temperature meets or exceeds a temperature threshold. In some embodiments, the temperature threshold is a temperature that could burn or harm a user of the airless hairdryer. In some embodiments, the temperature threshold is between about 100-125° F. If the temperature meets or exceeds the temperature threshold, the method 800 proceeds to block 825.

In block 825, the electrical fields are turned off or otherwise disabled. In some embodiments, the current source stops emitting a current. In some embodiments, the power source stops transmitting power.

Returning to decision block 820, if the temperature does not meet or exceed the temperature threshold, the method 800 proceeds to block 810.

Figure 9:
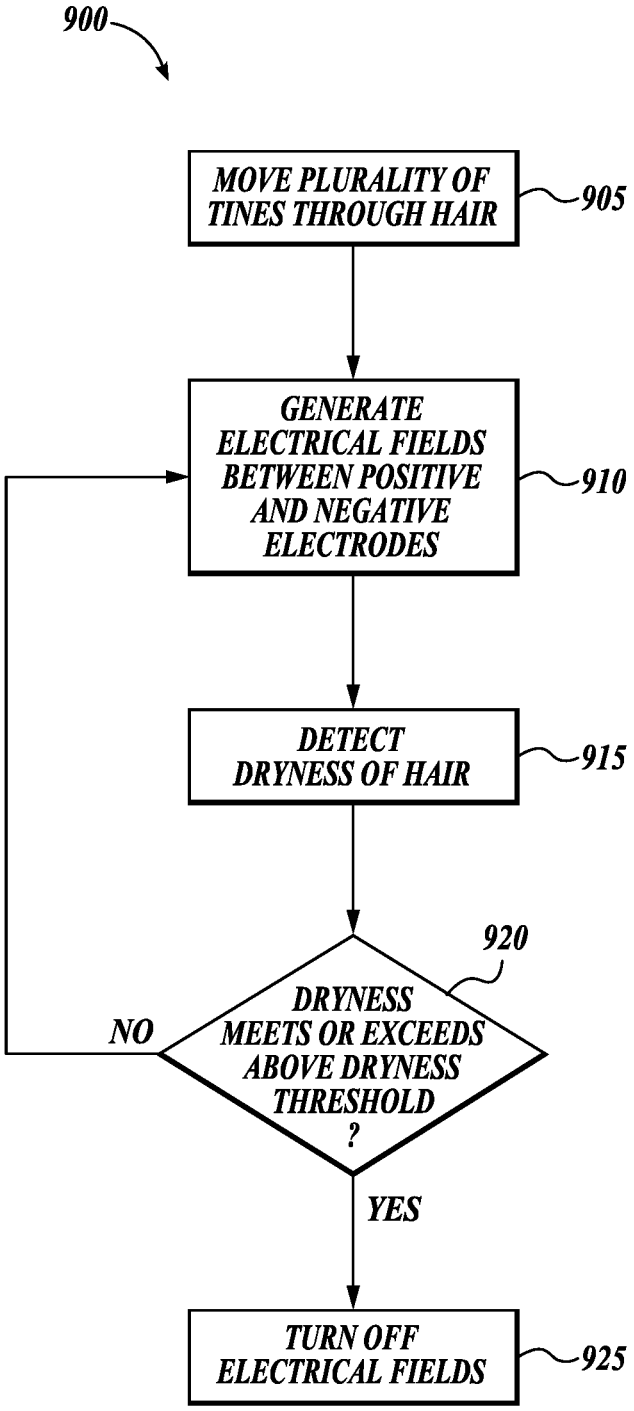
FIG. 9 is another example method of using an airless hairdryer, in accordance with the present technology.

FIG. 9 is another example method 900 of using an airless hairdryer, in accordance with the present technology. The method 900 may be performed by any of the airless hairdryers (100, 200, 300, 400, 500, 600) described herein. In some embodiments, the airless hairdryer includes a body (such as body 102, 302, 402, 502, 602) and at least one plurality of tines (such as plurality of tines 105A, 105B, 105C . . . 105N, 205A, 205B, 305A, 305B, 305C, 405A, 405B, 405C, 505A, 505B, 505C, 605A, 605B, 605C). In some embodiments, the airless hairdryer also includes a processor (such as processor 130), a current source (such as current source 135, 235) and/or a power source (such as power source 140). In some embodiments, the airless hairdryer also includes one or more temperature sensors (such as temperature sensor 115), one or more proximity sensors (such as proximity sensor 125), one or more vapor sensors (such as vapor sensor 120 and/or plurality of vapor sensors 120A, 120B, 120C . . . 120N), and/or one or more infrared light-emitting diodes (IR LEDs) (such as plurality of IR LEDs 350A, 350B, 350C).

In block 905, the plurality of tines is moved through hair (or hair strands, such as hair strands 2000). In some embodiments, the plurality of tines is located on the body of the airless hairdryer. The body may have a first face (such a first face 402A, 502A, 602A) and/or a second face (such as second face 402B, 502B, 602B). In some embodiments, the plurality of tines may be located on the first face and/or the second face, and on one or more sides (such as a frontside of the first face FS1, a frontside of the second face FS2, a first side S1, and/or a second side S2) of the first face and/or the second face.

In block 910, electrical fields (also referred to herein as an alternating electrical fields) are generated between positive electrodes (such as positive electrodes 110A, 110A-i, 110A-ii) of one tine of the plurality of tines and negative electrodes (such as negative electrodes 110B, 110B-i, 110B-ii) of an adjacent tine of the plurality of tines. As described herein, an adjacent tine may refer to one or more tines of the plurality of tines directly next to another tine of the plurality of tines. When the plurality of tines is arranged in a line (as shown in FIGS. 1A-1B, 3A-3B, 5A-5C, and 6A-6C) the adjacent tine is one or more tines located directly on either side of a tine of the plurality of tines. When the plurality of tines is arranged in an array (as shown in FIGS. 3C-3D, 4A-4C, and 5A-5C) the adjacent tine may be one or more tines in any cardinal direction, along any line, such as within the same column or same row, or at a diagonal. When the airless hairdryer includes more than one plurality of tines (as shown in FIGS. 4A-4C, 5A-5C, and 6A-6C) the adjacent tine may be a tine of the same plurality of tines as the one tine, or a tine of another plurality of tines as the one tine.

In block 915, a dryness (or dryness level) of the hair is detected. In some embodiments, the dryness level may be measured by the vapor sensor. In some embodiments, the vapor sensor may be located in the body of the airless hairdryer, or one or more tines of the plurality of tines. In some embodiments, the vapor sensor may be located at a base of one or more tines of the plurality of tines. In some embodiments, there may be a vapor sensor in each tine of the plurality of tines.

In decision block 920, it is determined whether the measured dryness level meets or exceeds a dryness threshold. If the dryness level meets or exceeds the dryness threshold, the method 900 proceeds to block 925.

In block 925, the electrical fields are turned off or otherwise disabled. In some embodiments, the current source stops emitting a current. In some embodiments, the power source stops transmitting power.

Returning to decision block 920, if the dryness level does not meet or exceed the dryness threshold, the method 900 proceeds to block 910.

Figure 10:
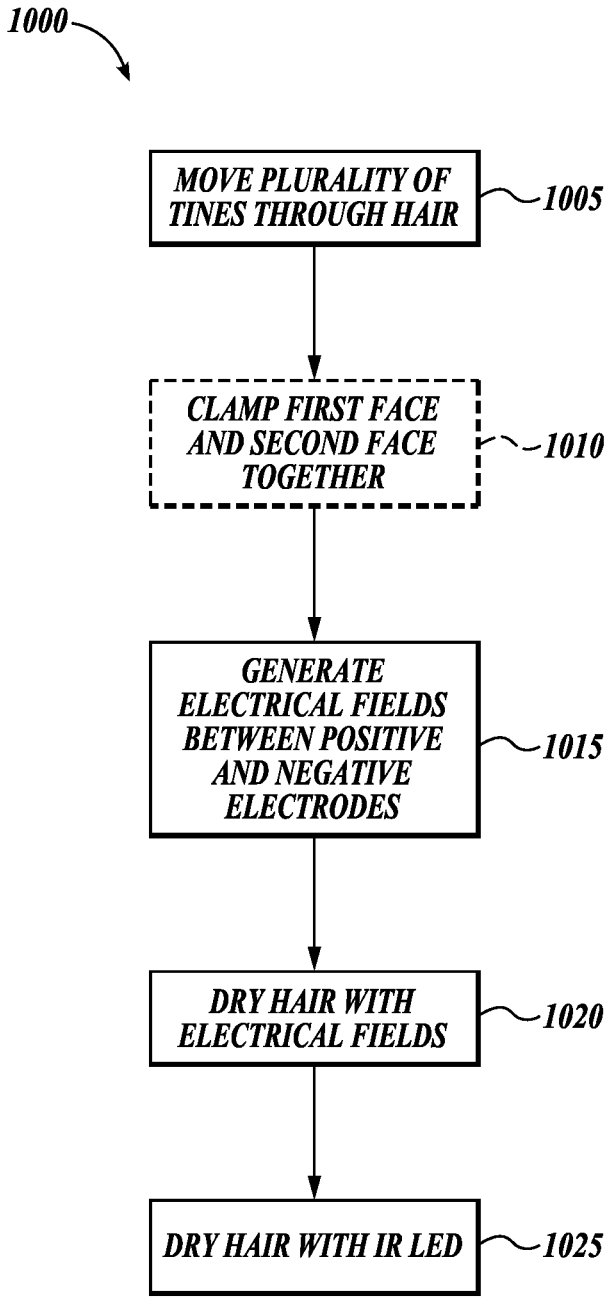
FIG. 10 is an example method of using an airless hairdryer with an infrared light-emitting diode, in accordance with the present technology.

FIG. 10 is an example method 1000 of using an airless hairdryer with an infrared light-emitting diode, in accordance with the present technology. The method 1000 may be performed by any of the airless hairdryers (100, 200, 300, 400, 500, 600) described herein. In some embodiments, the airless hairdryer includes a body (such as body 102, 302, 402, 502, 602) and at least one plurality of tines (such as plurality of tines 105A, 105B, 105C . . . 105N, 205A, 205B, 305A, 305B, 305C, 405A, 405B, 405C, 505A, 505B, 505C, 605A, 605B, 605C). In some embodiments, the airless hairdryer also includes a processor (such as processor 130), a current source (such as current source 135, 235) and/or a power source (such as power source 140). In some embodiments, the airless hairdryer also includes one or more temperature sensors (such as temperature sensor 115), one or more proximity sensors (such as proximity sensor 125), one or more vapor sensors (such as vapor sensor 120 and/or plurality of vapor sensors 120A, 120B, 120C . . . 120N), and/or one or more infrared light-emitting diodes (IR LEDs) (such as plurality of IR LEDs 350A, 350B, 350C).

In block 1005, the plurality of tines is moved through hair (or hair strands, such as hair strands 2000). In some embodiments, the plurality of tines is located on the body of the airless hairdryer. The body may have a first face (such a first face 402A, 502A, 602A) and/or a second face (such as second face 402B, 502B, 602B). In some embodiments, the plurality of tines may be located on the first face and/or the second face, and on one or more sides (such as a frontside of the first face FS1, a frontside of the second face FS2, a first side S1, and/or a second side S2) of the first face and/or the second face.

Optionally, in block 1010, the first face and the second face are clamped together (such as shown in FIGS. 4B, 5B, and 6B). In some embodiments, the plurality of tines on the first face interlock or alternate with the plurality of tines on the second face.

In block 1015, electrical fields (also referred to herein as an alternating electrical fields) are generated between positive electrodes (such as positive electrodes 110A, 110A-i, 110A-ii) of one tine of the plurality of tines and negative electrodes (such as negative electrodes 110B, 110B-i, 110B-ii) of an adjacent tine of the plurality of tines. As described herein, an adjacent tine may refer to one or more tines of the plurality of tines directly next to another tine of the plurality of tines. When the plurality of tines is arranged in a line (as shown in FIGS. 1A-1B, 3A-3B, 5A-5C, and 6A-6C) the adjacent tine is one or more tines located directly on either side of a tine of the plurality of tines. When the plurality of tines is arranged in an array (as shown in FIGS. 3C-3D, 4A-4C, and 5A-5C) the adjacent tine may be one or more tines in any cardinal direction, along any line, such as within the same column or same row, or at a diagonal. When the airless hairdryer includes more than one plurality of tines (as shown in FIGS. 4A-4C, 5A-5C, and 6A-6C) the adjacent tine may be a tine of the same plurality of tines as the one tine, or a tine of another plurality of tines as the one tine.

In block 1020, the hair is dried with the alternating electrical fields. In some embodiments, the current source supplies a current to the electrodes. The electrodes may generate alternating electric fields between them. The alternating energy of the alternating electric fields causes polar molecules in water to continuously re-orient them to face opposite poles, much in the way magnets move in an alternating magnetic field. In this manner, hair strands having positive and negative poles may orient towards the electrodes. In this manner, the movement of the polar molecules in the water causes friction, which allows the water in the hair strands to rapidly evaporate through the hair strands, effectively drying the hair.

In block 1025, the hair is dried with one or more IR LEDs. In some embodiments, the IR LEDs radiate or transfer IR energy to the hair. In some embodiments, the IR energy has a wavelength between 0.78 and 1000 μm. In some embodiments, the IR energy is short wave IR (about 0.78 to 2 μm), medium wave IR (about 2 to 4 μm), and/or long wave IR (about 4 to 1000 μm). In some embodiments, block 1020 and block 1025 happen simultaneously, that is the IR LEDs dry the hair while the alternating electric fields are generated between the plurality of tines. In some embodiments, block 1020 and block 1025 happen consecutively. In some embodiments, the IR LEDs are configured to dry the hair independently from the alternating electric fields, such as before the alternating electric fields are is generated, after the alternating electric fields is generated, or both. In some embodiments, blocks 1020 and 1025 are alternated, that is, the alternating electric fields and the IR LEDs 350A, 350B, 350C are alternated as a user moves the airless hairdryer 300 through hair.

Figure 11:
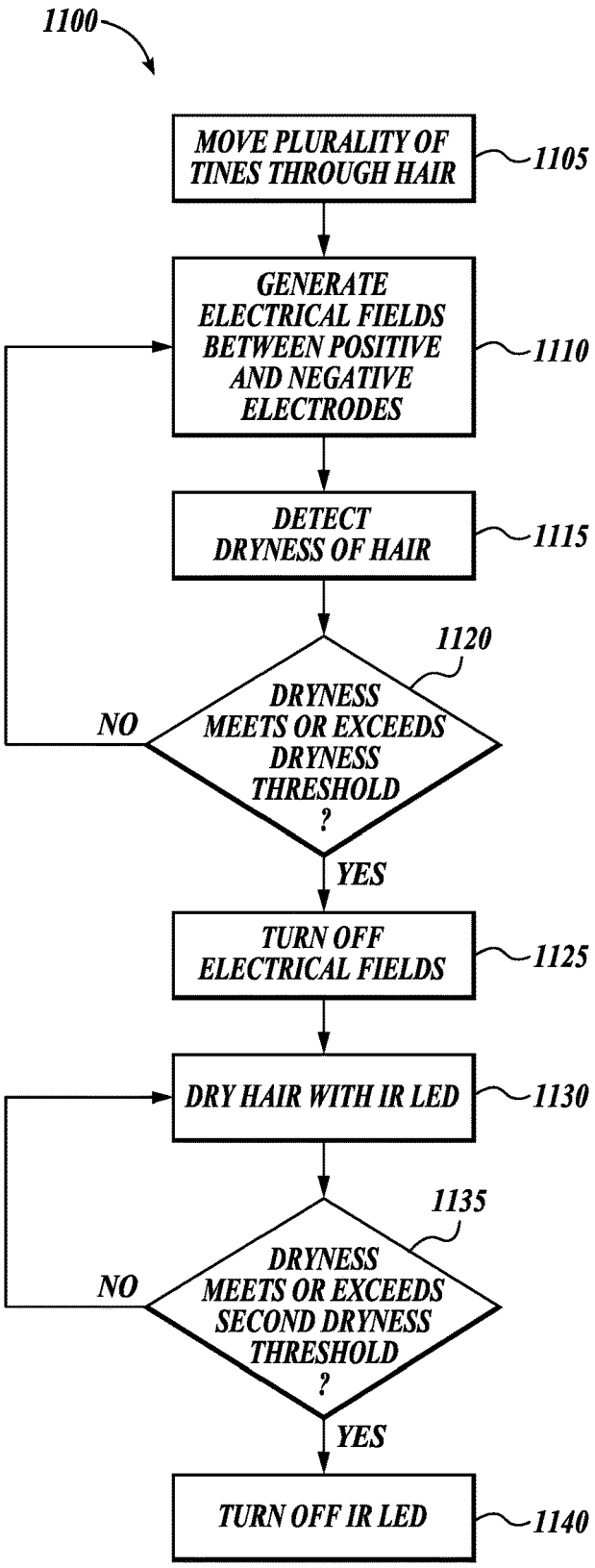
FIG. 11 is another example method of using an airless hairdryer with an infrared light-emitting diode, in accordance with the present technology.

FIG. 11 is another example method 1100 of using an airless hairdryer with an infrared light-emitting diode, in accordance with the present technology. The method 1100 may be performed by any of the airless hairdryers (100, 200, 300, 400, 500, 600) described herein. In some embodiments, the airless hairdryer includes a body (such as body 102, 302, 402, 502, 602) and at least one plurality of tines (such as plurality of tines 105A, 105B, 105C . . . 105N, 205A, 205B, 305A, 305B, 305C, 405A, 405B, 405C, 505A, 505B, 505C, 605A, 605B, 605C). In some embodiments, the airless hairdryer also includes a processor (such as processor 130), a current source (such as current source 135, 235) and/or a power source (such as power source 140). In some embodiments, the airless hairdryer also includes one or more temperature sensors (such as temperature sensor 115), one or more proximity sensors (such as proximity sensor 125), one or more vapor sensors (such as vapor sensor 120 and/or plurality of vapor sensors 120A, 120B, 120C . . . 120N), and/or one or more infrared light-emitting diodes (IR LEDs) (such as plurality of IR LEDs 350A, 350B, 350C).

In block 1105, the plurality of tines is moved through hair (or hair strands, such as hair strands 2000). In some embodiments, the plurality of tines is located on the body of the airless hairdryer. The body may have a first face (such a first face 402A, 502A, 602A) and/or a second face (such as second face 402B, 502B, 602B). In some embodiments, the plurality of tines may be located on the first face and/or the second face, and on one or more sides (such as a frontside of the first face FS1, a frontside of the second face FS2, a first side S1, and/or a second side S2) of the first face and/or the second face.

In block 1110, electrical fields (also referred to herein as an alternating electrical fields) are generated between positive electrodes (such as positive electrodes 110A, 110A-i, 110A-ii) of one tine of the plurality of tines and negative electrodes (such as negative electrodes 110B, 110B-i, 110B-ii) of an adjacent tine of the plurality of tines. As described herein, an adjacent tine may refer to one or more tines of the plurality of tines directly next to another tine of the plurality of tines. When the plurality of tines is arranged in a line (as shown in FIGS. 1A-1B, 3A-3B, 5A-5C, and 6A-6C) the adjacent tine is one or more tines located directly on either side of a tine of the plurality of tines. When the plurality of tines is arranged in an array (as shown in FIGS. 3C-3D, 4A-4C, and 5A-5C) the adjacent tine may be one or more tines in any cardinal direction, along any line, such as within the same column or same row, or at a diagonal. When the airless hairdryer includes more than one plurality of tines (as shown in FIGS. 4A-4C, 5A-5C, and 6A-6C) the adjacent tine may be a tine of the same plurality of tines as the one tine, or a tine of another plurality of tines as the one tine.

In block 1115, a dryness (or dryness level) of the hair is detected. In some embodiments, the dryness level may be measured by the vapor sensor. In some embodiments, the vapor sensor may be located in the body of the airless hairdryer, or one or more tines of the plurality of tines. In some embodiments, the vapor sensor may be located at a base of one or more tines of the plurality of tines. In some embodiments, there may be a vapor sensor in each tine of the plurality of tines.

In decision block 1120, it is determined whether the measured dryness level meets or exceeds a dryness threshold. If the dryness level meets or exceeds the dryness threshold, the method 1100 proceeds to block 1125.

In block 1125, the electrical fields are turned off or otherwise disabled. In some embodiments, the current source stops emitting a current. In some embodiments, the power source stops transmitting power.

In block 1130, the hair is dried with one or more IR LEDs. In some embodiments, the IR LEDs radiate or transfer IR energy to the hair. In some embodiments, the IR energy has a wavelength between 0.78 and 1000 μm. In some embodiments, the IR energy is short wave IR (about 0.78 to 2 μm), medium wave IR (about 2 to 4 μm), and/or long wave IR (about 4 to 1000 μm). In some embodiments, block 1020 and block 1025 happen simultaneously, that is the IR LEDs dry the hair while the alternating electric fields are generated between the plurality of tines. In some embodiments, block 1020 and block 1025 happen consecutively. In some embodiments, the IR LEDs are configured to dry the hair independently from the alternating electric fields, such as before the alternating electric fields are generated, after the alternating electric fields are generated, or both. In some embodiments, blocks 1020 and 1025 are alternated, that is, the alternating electric fields and the IR LEDs 350A, 350B, 350C are alternated as a user moves the airless hairdryer 300 through hair.

In decision block 1135, it is determined whether the measured dryness level meets or exceeds a second dryness threshold. In some embodiments, the second dryness threshold is a higher dryness level (drier) than the first dryness threshold. If the dryness level meets or exceeds the second dryness threshold, the method 1100 proceeds to block 1125.

In block 1140, the one or more IR LEDs are turned off or otherwise disabled. In some embodiments, the power source stops transmitting power. In some embodiments, the processor directs the one or more IR LEDs to turn off.

Returning to decision block 1135, if the dryness level does not meet or exceed the second dryness threshold, the method 1100 returns to block 1130.

It should be understood that all methods 700, 800, 900, 1000, and 1100 should be interpreted as merely representative. In some embodiments, process blocks of all methods 700, 800, 900, 1000, and 1100 may be performed simultaneously, sequentially, in a different order, or even omitted, without departing from the scope of this disclosure.

While illustrative embodiments have been illustrated and described, it will be appreciated that various changes can be made therein without departing from the spirit and scope of the invention.

The present application may reference quantities and numbers. Unless specifically stated, such quantities and numbers are not to be considered restrictive, but representative of the possible quantities or numbers associated with the present application. Also, in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

Embodiments disclosed herein may utilize circuitry in order to implement technologies and methodologies described herein, operatively connect two or more components, generate information, determine operation conditions, control an appliance, device, or method, and/or the like. Circuitry of any type can be used. In an embodiment, circuitry includes, among other things, one or more computing devices such as a processor (e.g., a microprocessor), a central processing unit (CPU), a digital signal processor (DSP), an application-specific integrated circuit (ASIC), a field-programmable gate array (FPGA), or the like, or any combinations thereof, and can include discrete digital or analog circuit elements or electronics, or combinations thereof.

An embodiment includes one or more data stores that, for example, store instructions or data. Non-limiting examples of one or more data stores include volatile memory (e.g., Random Access memory (RAM), Dynamic Random Access memory (DRAM), or the like), non-volatile memory (e.g., Read-Only memory (ROM), Electrically Erasable Programmable Read-Only memory (EEPROM), Compact Disc Read-Only memory (CD-ROM), or the like), persistent memory, or the like. Further non-limiting examples of one or more data stores include Erasable Programmable Read-Only memory (EPROM), flash memory, or the like. The one or more data stores can be connected to, for example, one or more computing devices by one or more instructions, data, or power buses.

In an embodiment, circuitry includes a computer-readable media drive or memory slot configured to accept signal-bearing medium (e.g., computer-readable memory media, computer-readable recording media, or the like). In an embodiment, a program for causing a system to execute any of the disclosed methods can be stored on, for example, a computer-readable recording medium (CRMM), a signal-bearing medium, or the like. Non-limiting examples of signal-bearing media include a recordable type medium such as any form of flash memory, magnetic tape, floppy disk, a hard disk drive, a Compact Disc (CD), a Digital Video Disk (DVD), Blu-Ray Disc, a digital tape, a computer memory, or the like, as well as transmission type medium such as a digital and/or an analog communication medium (e.g., a fiber optic cable, a waveguide, a wired communications link, a wireless communication link (e.g., transmitter, receiver, transceiver, transmission logic, reception logic, etc.). Further non-limiting examples of signal-bearing media include, but are not limited to, DVD-ROM, DVD-RAM, DVD+RW, DVD-RW, DVD-R, DVD+R, CD-ROM, Super Audio CD, CD-R, CD+R, CD+RW, CD-RW, Video Compact Discs, Super Video Discs, flash memory, magnetic tape, magneto-optic disk, MINIDISC, non-volatile memory card, EEPROM, optical disk, optical storage, RAM, ROM, system memory, web server, or the like.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification.

In the foregoing description, specific details are set forth to provide a thorough understanding of exemplary embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. An airless hairdryer comprising:

a plurality of tines protruding from a body, each tine of the plurality of tines comprising:

a positive electrode, and a negative electrode, wherein the positive electrode and the negative electrode of each tine of the plurality of tines are arranged in an alternating pattern;

a current source configured to generate alternating electric fields between each tine in the plurality of tines, wherein each alternating electric field is between one positive electrode of one tine and one negative electrode of an adjacent tine; and a vapor sensor configured to detect a dryness of the hair, wherein when the dryness detected by the vapor sensor meets or exceeds a dryness threshold, the alternating electric fields are disabled.

2. The airless hairdryer of claim 1, wherein the plurality of tines is disposed in a line.

3. The airless hairdryer of claim 1, wherein the plurality of tines is disposed in an array.

4. The airless hairdryer of claim 1, wherein the adjacent tine is one or more tines directly next to the one tine.

5. The airless hairdryer of claim 1, wherein the body comprises:

a first face;

a second face; and a clamp mechanism configured to bring the first face and the second face towards each other.

6. The airless hairdryer of claim 1, wherein the plurality of tines is located on a front side of the first face, a front side of the second face, or both the front side of the first face and the front side of the second face.

7. The airless hairdryer of claim 6, wherein the plurality of tines is located on a first side of the first face, a second side of the first face, a first side of the second face, a second side of the second face, or a combination thereof.

8. The airless hairdryer of claim 1, further comprising a temperature sensor configured to sense a temperature of a scalp, wherein when the temperature detected by the vapor sensor meets or exceeds a temperature threshold, the alternating electric fields are disabled.

9. The airless hairdryer of claim 1, wherein the vapor sensor is a plurality of vapor sensors, wherein each tine of the plurality of tines comprises a vapor sensor of the plurality of vapor sensors, each vapor sensor configured to detect a dryness of the scalp, and when the dryness detected by the vapor sensor meets or exceeds a dryness threshold, an alternating electric field of the respective tines of the plurality of tines is disabled.

10. The airless hairdryer of claim 1, further comprising at least one infrared (IR) light-emitting diode (LED) configured to further dry the hair.

11. A method of drying hair with the airless hairdryer of claim 1, the method comprising:

moving the plurality of tines through hair;

generating alternating electric fields between each tine in the plurality of tines, wherein each alternating electric field is between one positive electrode of one tine and one negative electrode of an adjacent tine;

drying the hair;

detecting a dryness of the hair with a vapor sensor; and when the temperature meets or exceeds a dryness threshold, disabling the alternating electrical fields.

12. The method of claim 11, wherein the airless hairdryer further comprises a first face, a second face, and a clamp mechanism, wherein the method further comprises:

clamping the first face and the second face towards each other as the plurality of tines is moved through the hair.

13. The method of claim 11, wherein the airless hairdryer further comprises a temperature sensor, and wherein the method further comprises:

detecting a temperature of a scalp; and when the temperature meets or exceeds a temperature threshold, disabling the alternating electrical fields.

14. The method of claim 12, wherein the temperature sensor is one temperature sensor of a plurality of temperature sensors, wherein each tine of the plurality of tines comprises a temperature sensor, and wherein the method further includes:

disabling an alternating electrical field of respective tines of the plurality of tines when a respective temperature sensor detects a temperature of the scalp meeting or exceeding the temperature threshold.

15. The method of claim 12, wherein the vapor sensor is one vapor sensor of a plurality of vapor sensors, wherein each tine of the plurality of tines comprises a vapor sensor, and wherein the method further includes:

disabling an alternating electrical field of respective tines of the plurality of tines when a respective vapor sensor detects a dryness of the hair meeting or exceeding the dryness threshold.

16. The method of claim 11, wherein the airless hairdryer further comprises at least one infrared (IR) light-emitting diode (LED), and wherein the method further comprises:

drying the hair with the at least one IR LED.

17. The method of claim 11, wherein the airless hairdryer further comprises at least one vapor sensor and at least one IR LED, wherein the method further comprises:

detecting a dryness of a scalp;

when the dryness meets or exceeds a dryness threshold, disabling the alternating electrical fields; and switching to drying the hair with the at least one IR LED.

18. The method of claim 17, wherein the method further comprises:

redetecting the dryness of the scalp, and when the dryness level meets or exceeds a second dryness threshold, turning off the at least one IR LED.

* * * * *